US008755713B2

(12) United States Patent
Kawai et al.

(10) Patent No.: US 8,755,713 B2
(45) Date of Patent: Jun. 17, 2014

(54) MANUFACTURING METHOD OF DEVELOPING DEVICE, REMANUFACTURING METHOD OF PROCESS CARTRIDGE, DEVELOPING DEVICE, AND PROCESS CARTRIDGE

(75) Inventors: Tachio Kawai, Odawara (JP); Shunsuke Uratani, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 157 days.

(21) Appl. No.: 13/444,168

(22) Filed: Apr. 11, 2012

(65) Prior Publication Data

US 2012/0269540 A1 Oct. 25, 2012

(30) Foreign Application Priority Data

Apr. 22, 2011 (JP) ..... 2011-096348

(51) Int. Cl.
*G03G 15/00* (2006.01)
*G03G 15/08* (2006.01)
*G03G 21/18* (2006.01)

(52) U.S. Cl.
CPC .. *G03G 15/0894* (2013.01); *G03G 2215/00987* (2013.01); *G03G 21/181* (2013.01)
USPC ..... 399/109

(58) Field of Classification Search
CPC ..... G03G 15/0894; G03G 2215/00987; G03G 21/181
USPC ..... 399/109
See application file for complete search history.

(56) References Cited

U.S. PATENT DOCUMENTS

| | | | |
|---|---|---|---|
| 5,585,902 | A | 12/1996 | Nishiuwatoko et al. |
| 5,870,654 | A | 2/1999 | Sato et al. |
| 5,903,803 | A | 5/1999 | Kawai et al. |
| 6,055,406 | A | 4/2000 | Kawai et al. |
| 6,097,907 | A | 8/2000 | Fujiwara |
| 6,115,567 | A | 9/2000 | Kawai et al. |

(Continued)

FOREIGN PATENT DOCUMENTS

| | | | |
|---|---|---|---|
| CN | 1101435 | A | 4/1995 |
| CN | 1182894 | A | 5/1998 |

(Continued)

OTHER PUBLICATIONS

Chinese Official Action dated Jan. 6, 2014, issued in counterpart Chinese Patent Application No. 201210118448.4, with an English translation.

*Primary Examiner* — Walter L Lindsay, Jr.
*Assistant Examiner* — Barnabas Fekete
(74) *Attorney, Agent, or Firm* — Fitzpatrick, Cella, Harper & Scinto

(57) ABSTRACT

A remanufacturing method of a developing device that includes a developer accommodating portion partitioned by a partitioning portion, a first opening provided in the partitioning portion and a seal member welded on the partitioning portion, surrounding the first opening, wherein the first opening is opened by removing the seal member to supply a developer to the outside. The method includes hermetically sealing, before or after re-filling the developer in the developer accommodating portion for reuse, the first opening by bonding, on the partitioning portion, a plate-like member, which is provided with a second opening corresponding to the first opening, and on which a reseal member for sealing the second opening is detachably bonded, at a region outside of a welding trace, a region inside of the trace, or a region ranging from an inside to an outside of the trace, so as to cover the welding trace.

18 Claims, 26 Drawing Sheets

(56) References Cited

U.S. PATENT DOCUMENTS

| | | | |
|---|---|---|---|
| 6,118,958 | A | 9/2000 | Nagashima |
| 6,128,454 | A | 10/2000 | Kawai et al. |
| 6,163,665 | A | 12/2000 | Watanabe et al. |
| 6,175,706 | B1 | 1/2001 | Watanabe et al. |
| 6,226,478 | B1 | 5/2001 | Watanabe et al. |
| 6,240,266 | B1 | 5/2001 | Watanabe et al. |
| 6,272,300 | B1 | 8/2001 | Fujiwara et al. |
| 6,336,018 | B1 | 1/2002 | Kawai et al. |
| 6,349,188 | B1 | 2/2002 | Kawai et al. |
| 6,381,430 | B1 | 4/2002 | Yokomori et al. |
| 6,463,232 | B1 | 10/2002 | Kawai et al. |
| 6,480,687 | B1 | 11/2002 | Kawai et al. |
| 6,496,667 | B2 | 12/2002 | Shirotori et al. |
| 6,501,926 | B1 | 12/2002 | Watanabe et al. |
| 6,501,927 | B1 | 12/2002 | Watanabe et al. |
| 6,560,422 | B2 | 5/2003 | Kanno et al. |
| 6,735,403 | B2 | 5/2004 | Kanno et al. |
| 6,738,588 | B2 | 5/2004 | Yokomori et al. |
| 6,931,226 | B2 | 8/2005 | Chadani et al. |
| 6,947,686 | B2 | 9/2005 | Kawai et al. |
| 6,968,142 | B2 | 11/2005 | Arimitsu et al. |
| 7,016,626 | B2 | 3/2006 | Yokomori et al. |
| 7,027,754 | B2 | 4/2006 | Harada et al. |
| 7,046,942 | B2 | 5/2006 | Arimitsu et al. |
| 7,085,516 | B2 | 8/2006 | Kawai et al. |
| 7,130,560 | B2 | 10/2006 | Kawai et al. |
| 7,233,752 | B2 | 6/2007 | Harada et al. |
| 7,257,353 | B2 | 8/2007 | Kawai et al. |
| 7,310,489 | B2 | 12/2007 | Kawai |
| 7,457,569 | B2 | 11/2008 | Kawai |
| 7,555,249 | B2 | 6/2009 | Kawai |
| 7,848,684 | B2 | 12/2010 | Kawai |
| 8,045,899 | B2 | 10/2011 | Kawai |
| 8,180,262 | B2 | 5/2012 | Kawai |
| 2009/0290903 | A1 | 11/2009 | Horikawa et al. |
| 2009/0290904 | A1 | 11/2009 | Kawai et al. |
| 2010/0221039 | A1 | 9/2010 | Kawai et al. |
| 2011/0229196 | A1 | 9/2011 | Kawai et al. |

FOREIGN PATENT DOCUMENTS

| | | | |
|---|---|---|---|
| CN | 1057850 | C | 10/2000 |
| CN | 1391142 | A | 1/2003 |
| EP | 0671670 | A2 | 9/1995 |
| JP | H06-173495 | A | 6/1994 |
| JP | 7-319362 | | 12/1995 |

MANUFACTURING METHOD OF DEVELOPING DEVICE, REMANUFACTURING METHOD OF PROCESS CARTRIDGE, DEVELOPING DEVICE, AND PROCESS CARTRIDGE

CLAIM FOR PRIORITY

This application claims priority from Japanese Patent Application No. 2011-096348, filed Apr. 22, 2011, which is hereby incorporated by reference.

FIELD OF THE INVENTION AND RELATED ART

The present invention relates to a developing device for use with an electrophotographic image forming apparatus, a process cartridge detachably mountable to the electrophotographic image forming apparatus, a remanufacturing method of the developing device, and a remanufacturing method of the process cartridge.

Here, in the present invention, the electrophotographic image forming apparatus forms an image on a recording material through an electrophotographic image forming process. Examples of the electrophotographic image forming apparatus are an electrophotographic copying machine, an electrophotographic printer (LED printer, a laser beam printer, etc.), a facsimile machine, and so on.

Further, the main assembly of the electrophotographic image forming apparatus is a portion of the electrophotographic image forming apparatus except for the process cartridge.

Further, the process cartridge is a cartridge that is prepared by integrally assembling an electrophotographic photosensitive drum and at least a developing means as process means actable on the drum, and which is detachably mountable to a main assembly of the electrophotographic image forming apparatus.

Further, the developing device accommodates a developer and includes a developing device frame for supporting a developer carrying member, and is used in the electrophotographic image forming apparatus.

In a conventional electrophotographic image forming apparatus in which the electrophotographic image forming process is used, the electrophotographic photosensitive drum, and the process means actable on the electrophotographic photosensitive drum, are integrated into a carriage. And, a process cartridge type in which this cartridge is detachably mountable to the main assembly of the electrophotographic image forming apparatus is employed.

According to this process cartridge type, maintenance of the image forming apparatus can be carried out by a user himself or herself without relying on a service person, and therefore, operability of the maintenance can be remarkably improved.

Further, in the electrophotographic image forming apparatus, an image is formed on a recording material using a developer. The developer is contained in a developer accommodating portion and is consumed as the process cartridge having the developing means repeats image formation.

And, when the developer has been consumed to such an extent that an image of a quality that can satisfy the user of the process cartridge cannot be formed, commercial value in the process cartridge is lost.

In recent years, a process cartridge that has lost its commercial value by the consumption of the developer has been commercialized again. With respect to such a remanufactured product, similarly as in a brand-new product, a sealing method in which the developer accommodated in the developer accommodating portion does not leak to the outside during a distribution process has been desired and devised (e.g., Japanese Laid Open Patent Application (JP-A) Hei 7-319362 (page 19, FIG. 17)).

SUMMARY OF THE INVENTION

The present invention further develops the prior art discussed above.

A principal object of the present invention is to provide a remanufacturing method of a developing device, a remanufacturing method of a process cartridge, a developer, and a process cartridge, wherein a developer in a developer accommodating portion does not leak to the outside even when the process cartridge is subjected to vibration or impact during a transportation process.

Another object of the present invention is to provide easy remanufacturing methods of the developing device and the process cartridge.

A further object of the present invention is to provide remanufacturing methods of the developing device and the process cartridge that are capable of commercializing the developing device and the process cartridge, which have lost their commercial value by consumption of the developer.

A further object of the present invention is to provide a developing device and a process cartridge, wherein re-filling of the developer is realized by an easy method.

According to an aspect of the present invention, a remanufacturing method of a developing device comprises a developer accommodating portion partitioned by a partitioning portion, a first opening provided in the partitioning portion and a seal member, welded on the partitioning portion that surrounds the first opening, for sealing the first opening, wherein the first opening is opened for use by removing the seal member from the partitioning portion to supply a developer to outside of the developer accommodating portion through the first opening, the method comprising hermetically sealing, before or after re-filling the developer in the developer accommodating portion for reuse from which the seal member has been removed, the first opening by bonding, on the partitioning portion, a plate-like member, which is provided with a second opening corresponding to the first opening, and on which a reseal member for sealing the second opening is detachably bonded, at a region outside of a welding trace where the seal member removed from the partitioning portion was welded, a region inside the welding trace, or a region ranging from an inside to an outside of the welding trace, so as to cover the welding trace.

According to another aspect of the present invention, a developing device for use with an electrophotographic image forming apparatus comprises a developer accommodating portion partitioned by a partitioning portion, a first opening provided at a partitioning portion, for supplying a developer accommodated in the developer accommodating container to outside of the developer accommodating portion, and a plate-like member for hermetically sealing the first opening, wherein the plate-like member is provided with a second opening corresponding to the first opening, and on which a reseal member for sealing the second opening is detachably bonded, and wherein the plate-like member is bonded, on the partitioning portion, at a region outside of a welding trace provided at the partitioning portion, a region inside the welding trace, or a region ranging from an inside to an outside of the welding trace, so as to cover the welding trace.

According to a further aspect of the present invention, a remanufacturing method of a process cartridge comprises an electrophotographic photosensitive member, a developing chamber provided with a developer carrying member for developing an electrostatic latent image formed on the electrophotographic photosensitive member with a developer, a developer accommodating portion partitioned from the developing chamber by a partitioning portion, a first opening provided in the partitioning portion and a seal member, welded on the partitioning portion that surrounds the first opening, for sealing the first opening, wherein the first opening is opened for use by removing the seal member from the partitioning portion to supply the developer from the developer accommodating portion to the developing chamber, the method comprising hermetically sealing, before or after refilling the developer in the developer accommodating portion for reuse from which the seal member has been removed, the first opening by bonding, on the partitioning portion, a plate-like member, which is provided with a second opening corresponding to the first opening, and on which a reseal member for sealing the second opening is detachably bonded, at a region outside of a welding trace where the seal member removed from the partitioning portion was welded, a region inside the welding trace, or a region ranging from an inside to an outside of the welding trace, so as to cover the welding trace.

According to a further aspect of the present invention, a process cartridge detachably mountable to an electrophotographic image forming apparatus comprises an electrophotographic photosensitive member, a developing chamber provided with a developer carrying member for developing an electrostatic latent image formed on the electrophotographic photosensitive member with a developer, a developer accommodating portion partitioned from the developing chamber by a partitioning portion, a first opening provided at a partitioning portion, for supplying a developer accommodated in the developer accommodating container to the developing chamber, and a plate-like member for hermetically sealing the first opening, wherein the plate-like member is provided with a second opening corresponding to the first opening, and on which a reseal member for sealing the second opening is detachably bonded, and wherein the plate-like member is bonded, on the partitioning portion, at a region outside of a welding trace provided at the partitioning portion, a region inside the welding trace, or a region ranging from an inside to an outside of the welding trace, so as to cover the welding trace.

These and other objects, features, and advantages of the present invention will become more apparent upon a consideration of the following description of the preferred embodiments of the present invention, taken in conjunction with the accompanying drawings.

Figure 11:
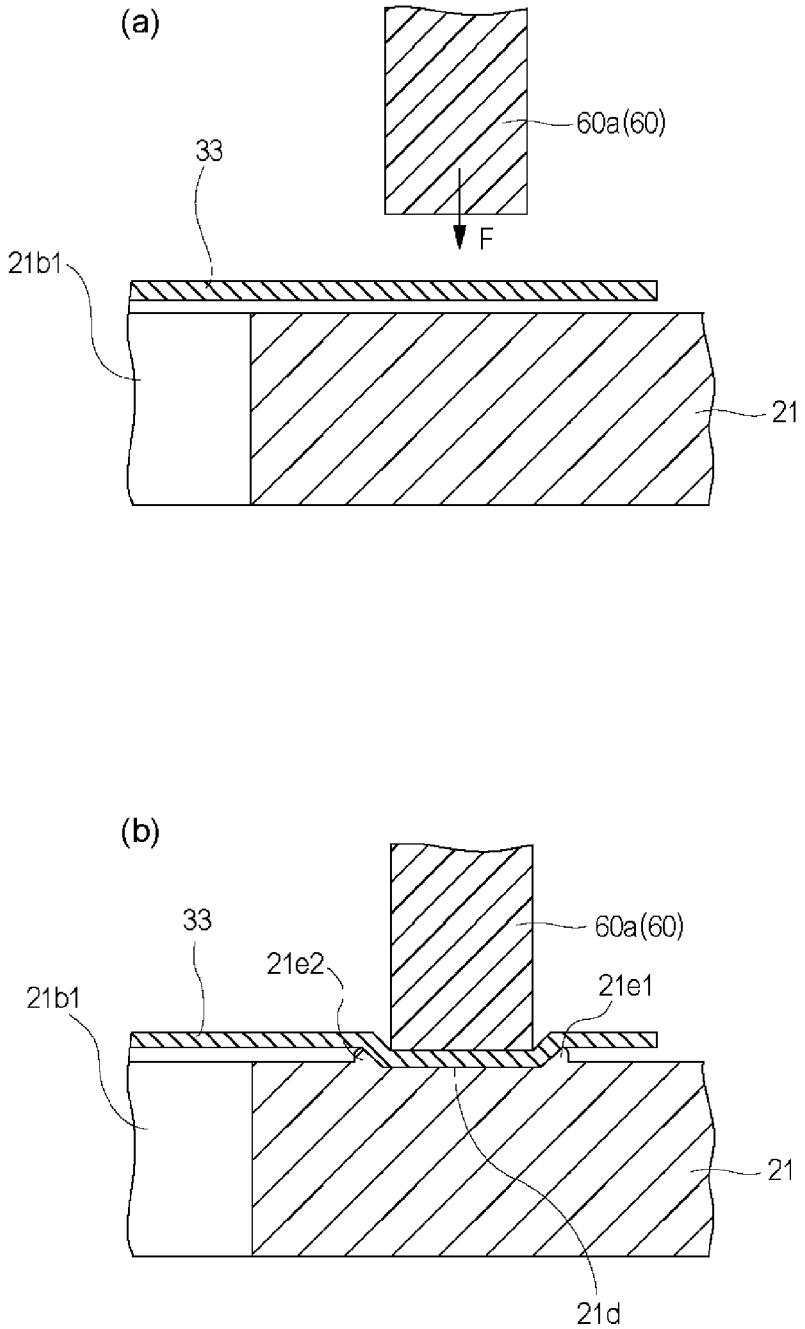

Parts (a) and (b) of FIG. 11 are schematic sectional views showing a deformation state of a container when the toner seal for the process cartridge in Embodiment 1 is welded.

FIGS. 12 to 15 are exploded perspective views of a drum unit of the process cartridge in Embodiment 1.

Figure 16:
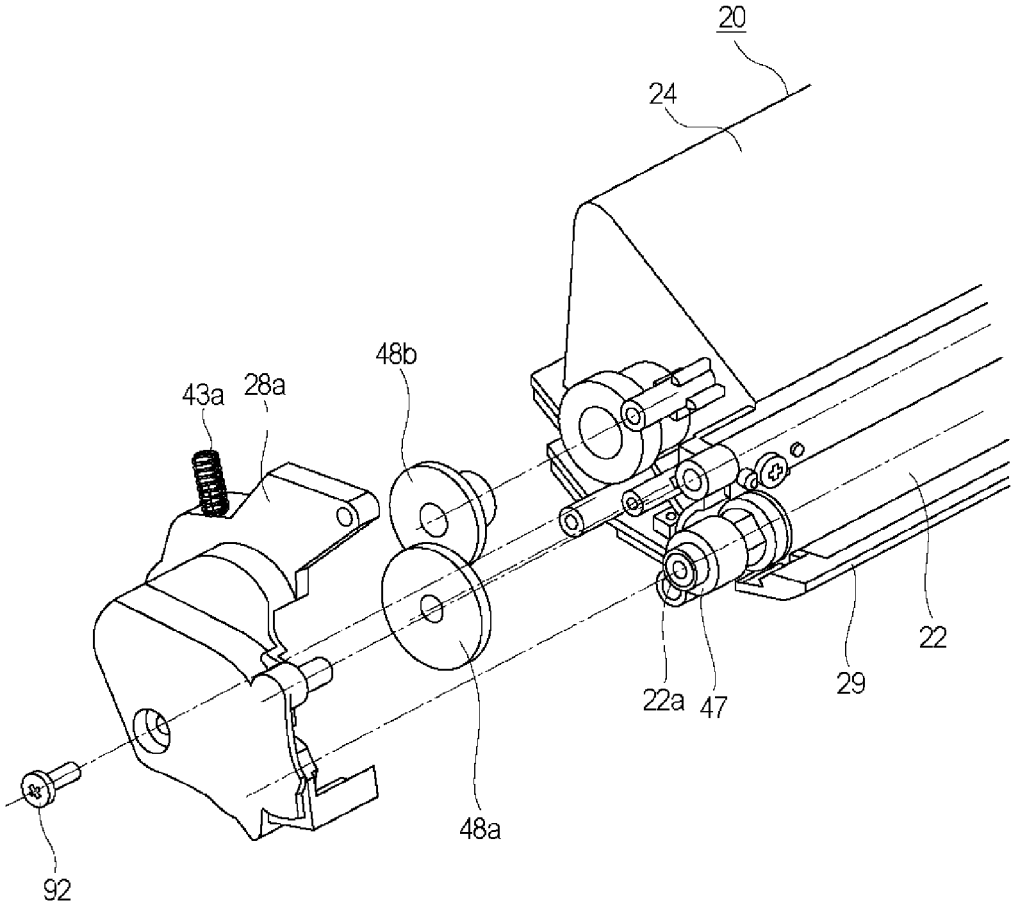

FIG. 16 is an exploded perspective view of the developing unit of the process cartridge in Embodiment 1 at one end side.

Figure 17:
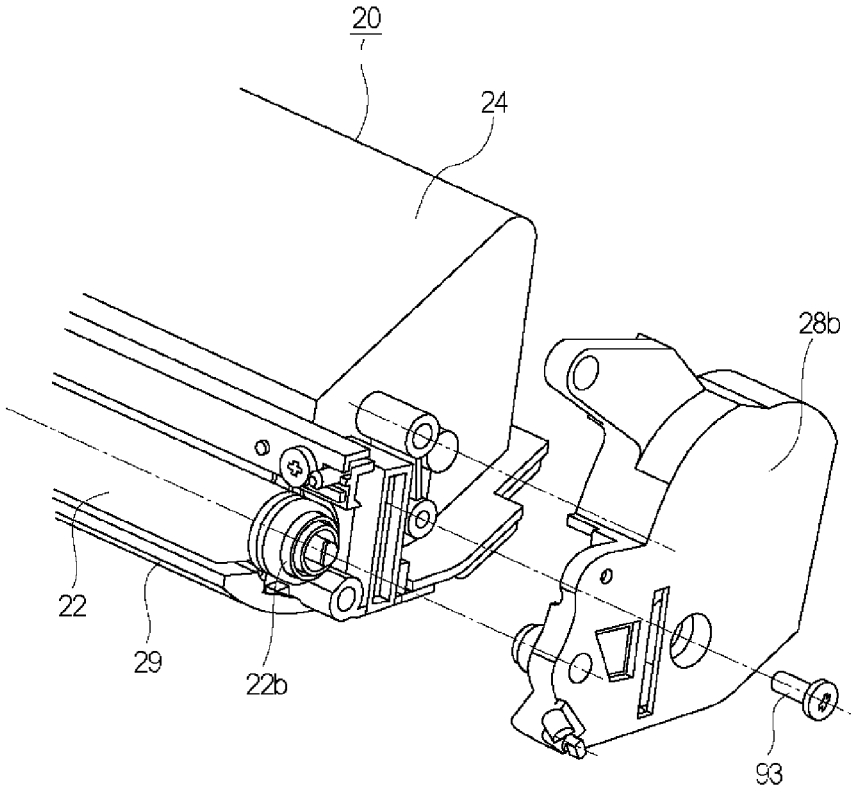

FIG. 17 is an exploded perspective view of the developing unit of the contact in Embodiment 1 at the other end side.

Figure 18:
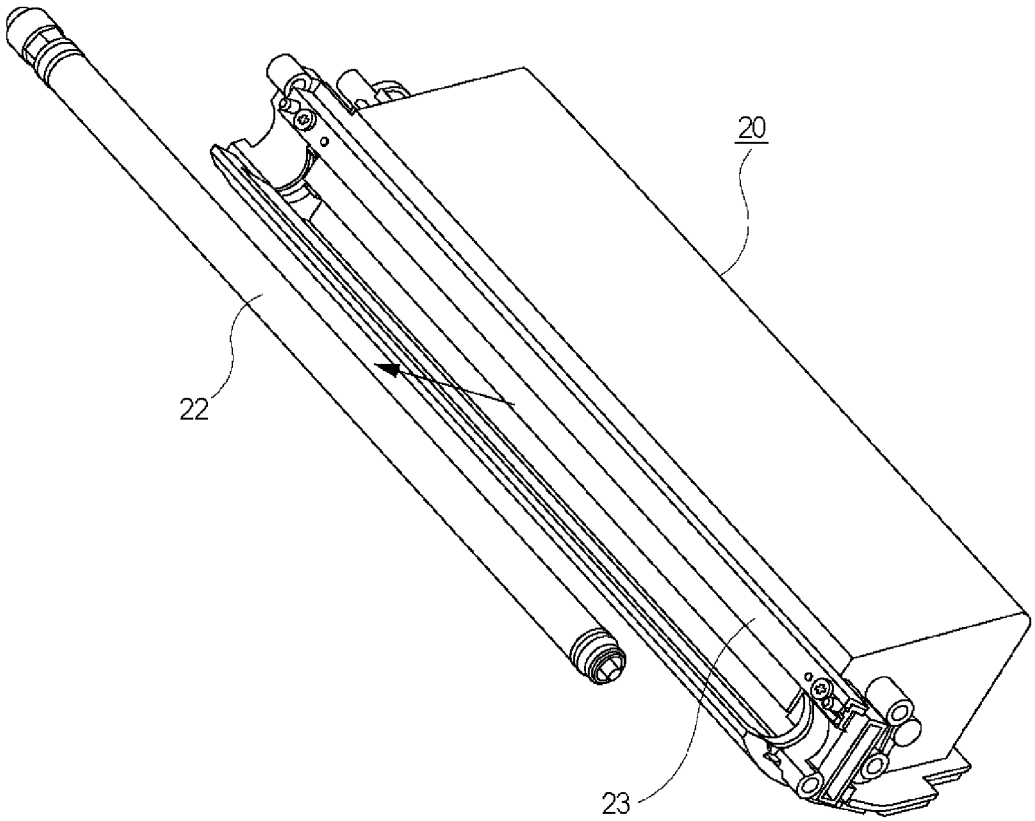
Figure 19:
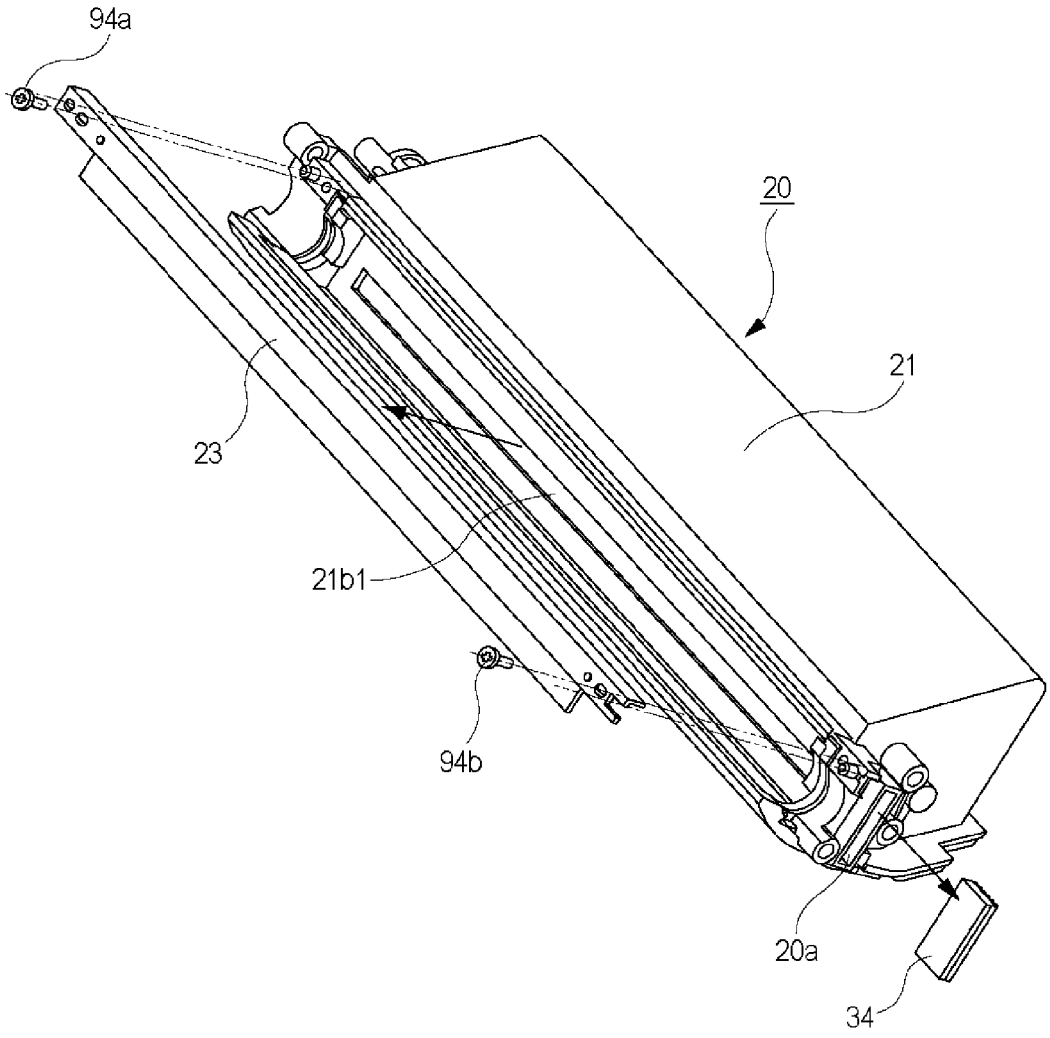

FIGS. 18 and 19 are exploded perspective views of the developing unit of the process cartridge in Embodiment 1.

Figure 20:
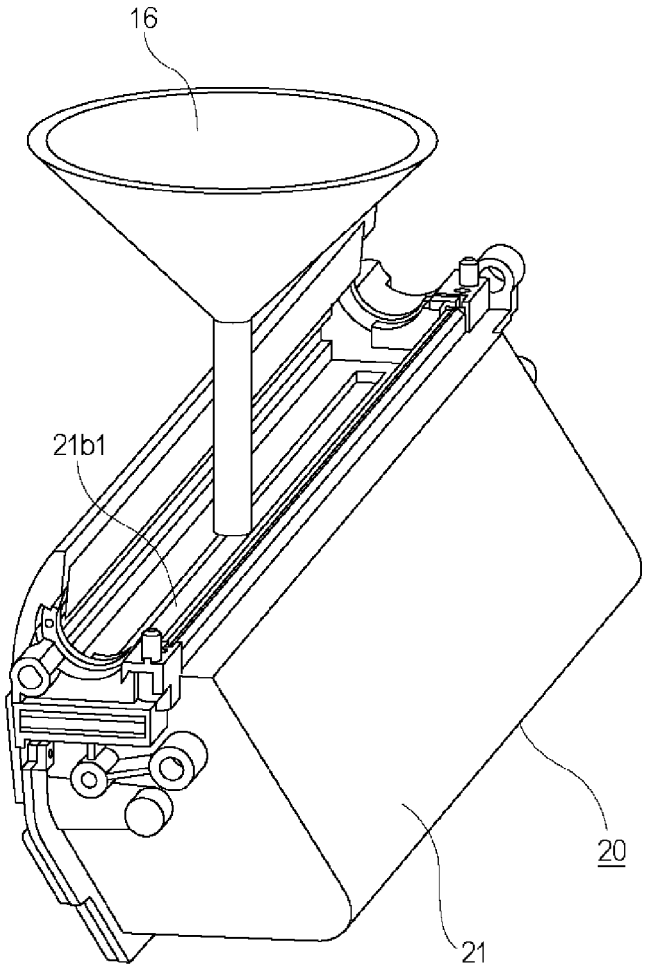

FIG. 20 is a perspective view for illustrating a toner refilling step for the process cartridge in Embodiment 1.

Figure 21:
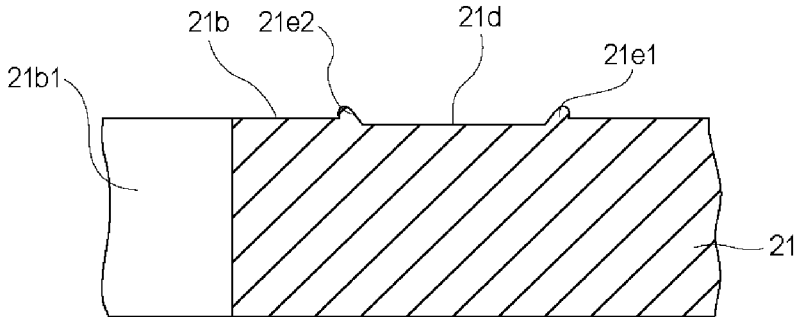

FIG. 21 is a schematic sectional view illustrating deformation of a partitioning portion after a toner seal for a conventional process cartridge is removed.

Figure 22:
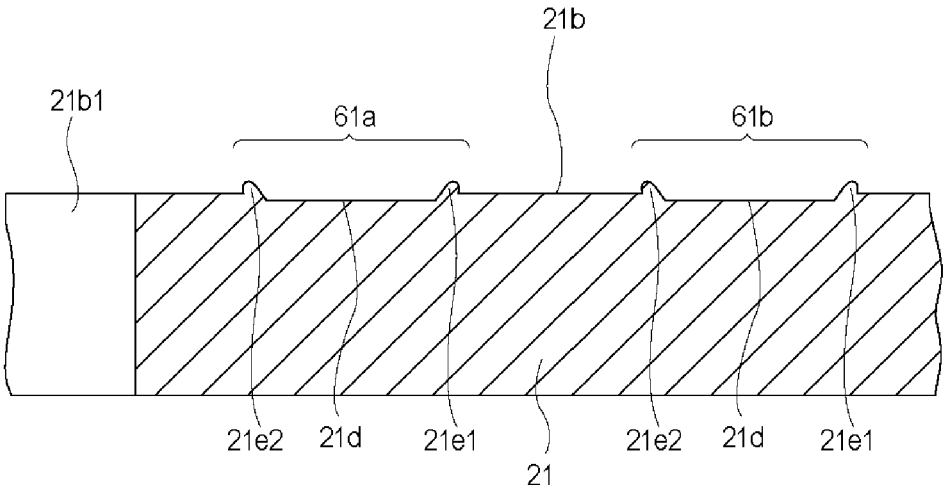

FIG. 22 is a schematic sectional view illustrating the deformation of the partitioning portion when the conventional process cartridge is remanufactured.

Figure 23:
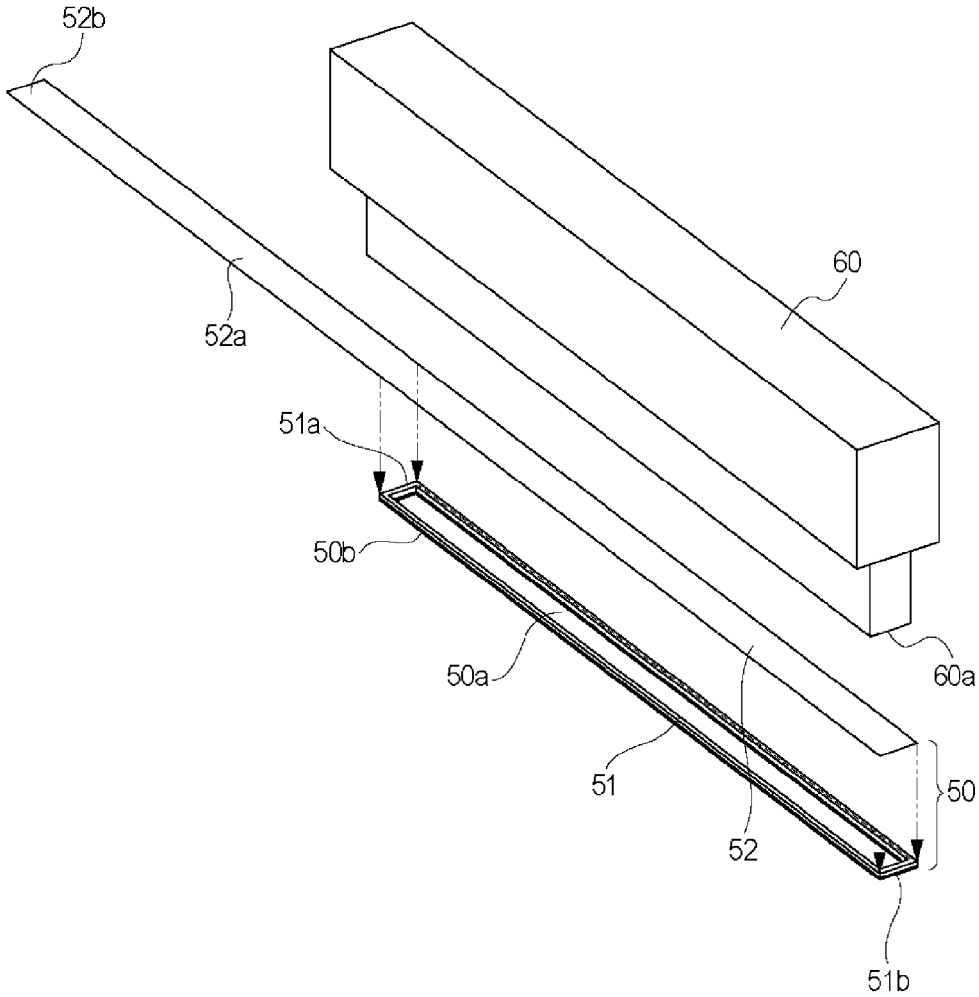

FIG. 23 is a perspective view illustrating a welding method of a seal unit when the process cartridge in Embodiment 1 is remanufactured.

Figure 24:
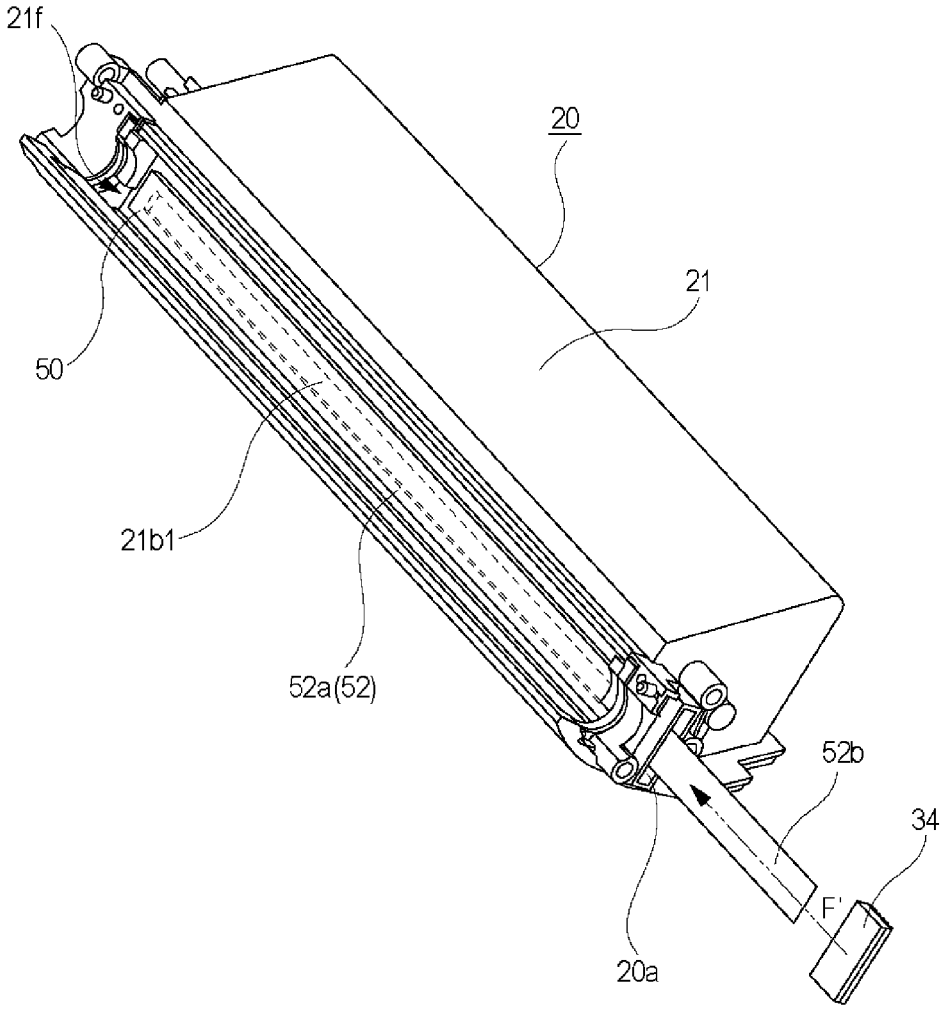

FIG. 24 is a perspective view illustrating a mounting method of the toner leakage preventing seal when the process cartridge in Embodiment 1 is remanufactured.

Figure 25:
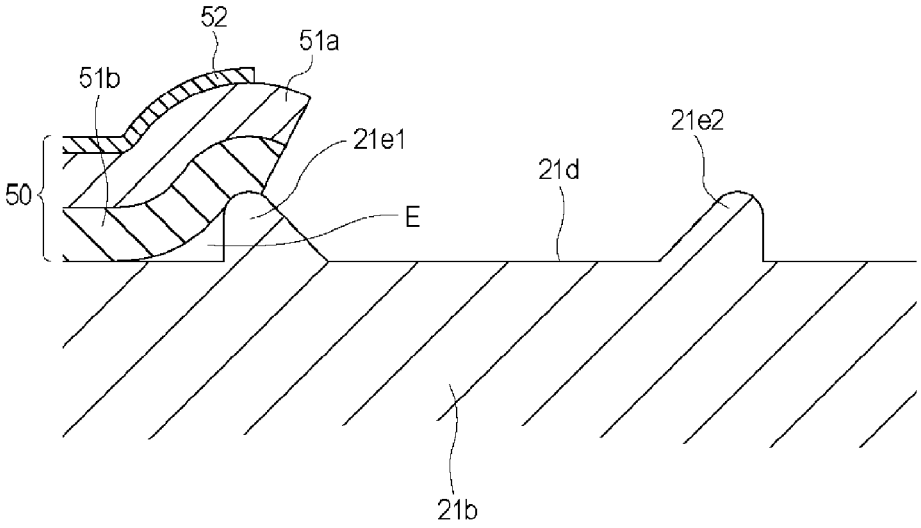

FIG. 25 is a schematic sectional view illustrating a deformation state of a seal unit mounting portion when a process cartridge in Embodiment 1 is remanufactured.

Figure 26:
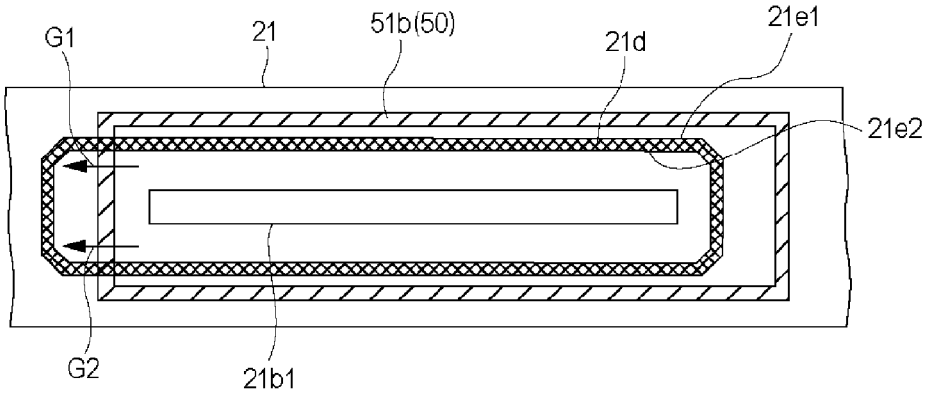

FIG. 26 is an illustration of a seal unit mounting state when a process cartridge in a comparative embodiment is remanufactured.

Figure 27:
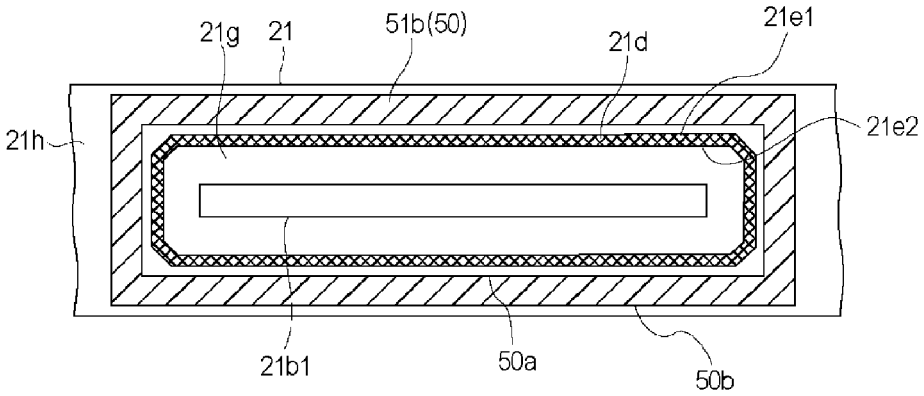

FIG. 27 is an illustration of a sealing method of the toner supply opening with the seal unit when the process cartridge in Embodiment 1 is remanufactured.

Figure 28:
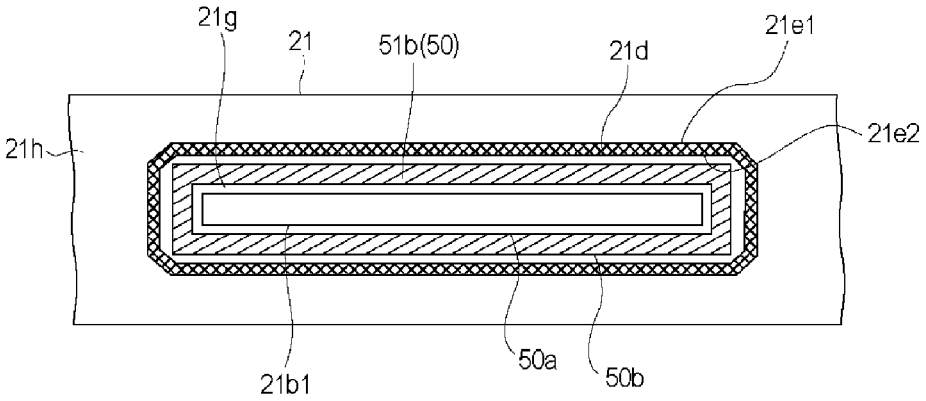

FIG. 28 is an illustration of another sealing method of a toner supply opening with a seal unit when a process cartridge in Embodiment 2 is remanufactured.

Figure 29:
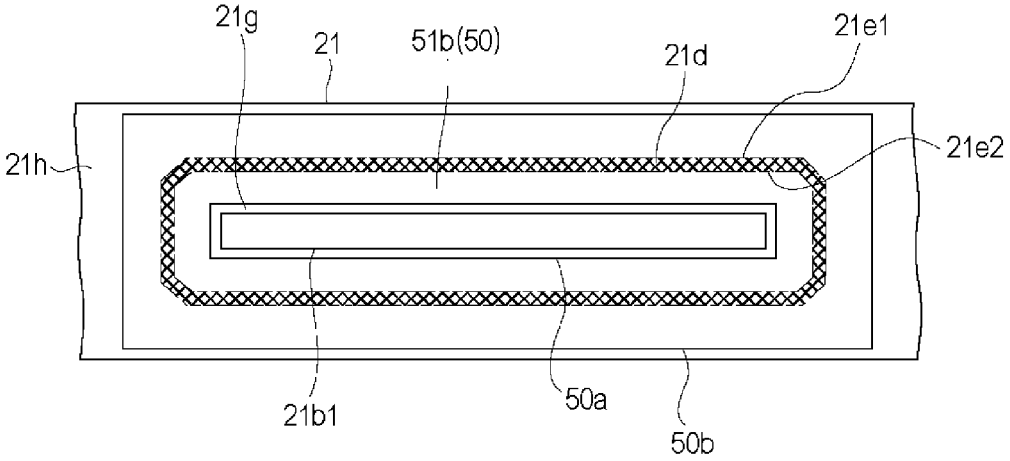

FIG. 29 is an illustration of another sealing method of a toner supply opening with a seal unit when a process cartridge in Embodiment 3 is remanufactured.

DESCRIPTION OF THE PREFERRED EMBODIMENTS

Referring to the accompanying drawings, the preferred embodiments of the present invention will be described. The function, material, configuration, positional relations, and the like, of the constituent elements in the range of the present invention are not limited to those described in the following embodiments, unless otherwise stated. The material, configuration, and the like, of members described once apply to the subsequent descriptions, unless otherwise stated.

[Embodiment 1]

A developing device and a process cartridge in this embodiment will be described with reference to the drawings. In the following description, a longitudinal direction of the process cartridge coincides with (is substantially parallel to) a rotational axis direction of an electrophotographic photosensitive drum as an image bearing member. Further, a widthwise direction of the process cartridge is a direction crossing (a direction substantially perpendicular to) a rotational shaft of the electrophotographic photosensitive drum (member), and coincides with a recording material conveyance direction. Further, with respect to the process cartridge, "upward" refers to that in a state in which the process cartridge is mounted in an apparatus main assembly, and "downward" refers to that in the mounted state.

(General Structure of an Image Forming Apparatus)

Figure 2:
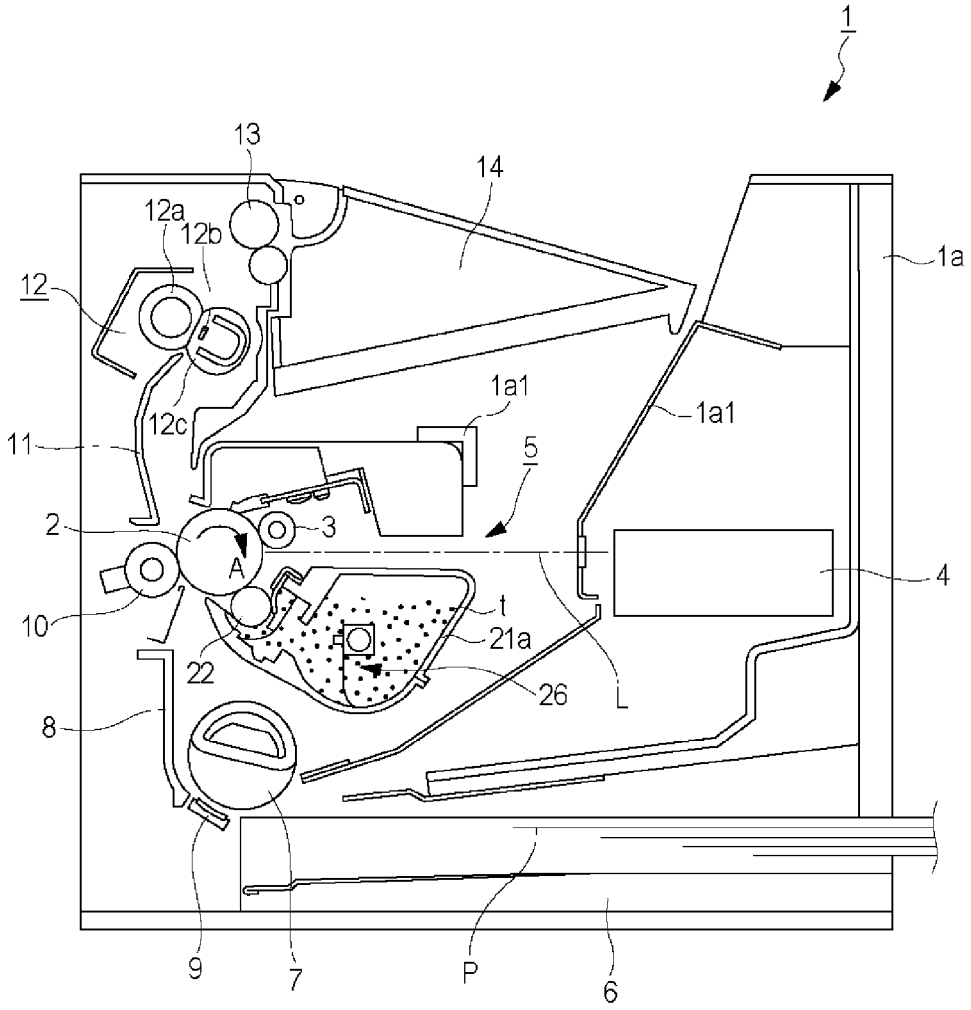
FIG. 2 is a general arrangement view showing an example of a general structure of an image forming apparatus in Embodiment 1.

First, an electrophotographic image forming apparatus in this embodiment will be described with reference to FIG. 2. An image forming apparatus 1 shown in FIG. 2 forms an image on a recording material (e.g., recording paper, an OHP sheet, cloth, or the like), by an electrophotographic image forming process, depending on image information from an external device, such as a personal computer communicatably connected with an apparatus main assembly 1*a*.

An electrophotographic photosensitive drum 2 as an image bearing member is rotated in an arrow A direction, so that the surface of the photosensitive drum 2 is uniformly charged by a charging roller 3 as a charging means. The photosensitive drum 2 is irradiated with laser light L, depending on the image information, from an optical means (exposure means) 4, so that an electrostatic latent image depending on the image information is formed on the photosensitive drum 2. The thus-formed electrostatic latent image on the photosensitive drum 2 is developed with a toner t as a developer by a developing roller 22, as a developer carrying member described later, to form a toner image.

On the other hand, in synchronism with the formation of the toner image, the recording material P set in a feeding cassette 6 is separated and fed one by one by a pick-up roller 7 and a press-contact member 9 press-contacting the pick-up roller 7. Then, along a conveying guide, the recording material P is conveyed to a transfer roller 10 as a transfer means. Next, the recording material P passes through a transfer nip formed by the photosensitive drum 2 and the transfer roller 10, to which a certain voltage is applied. At this time, the toner image formed on the photosensitive drum 2 is transferred onto the recording material P. The recording material P, onto which the toner image is transferred, is conveyed to a fixing means 12 by a conveying guide 11. This fixing device 12 includes a driving roller 12*a* and a fixing roller 12*c*, in which a heater 12*b* is incorporated. In the fixing device 12, heat and pressure are applied to the recording material P, passing through a nip formed by the fixing roller 12*c* and the driving roller 12*a*, so that the transferred toner image is fixed. Thereafter, the recording material P is conveyed by a discharging roller pair 13 and is discharged on a discharge tray 14.

(Process Cartridge)

Figure 3:
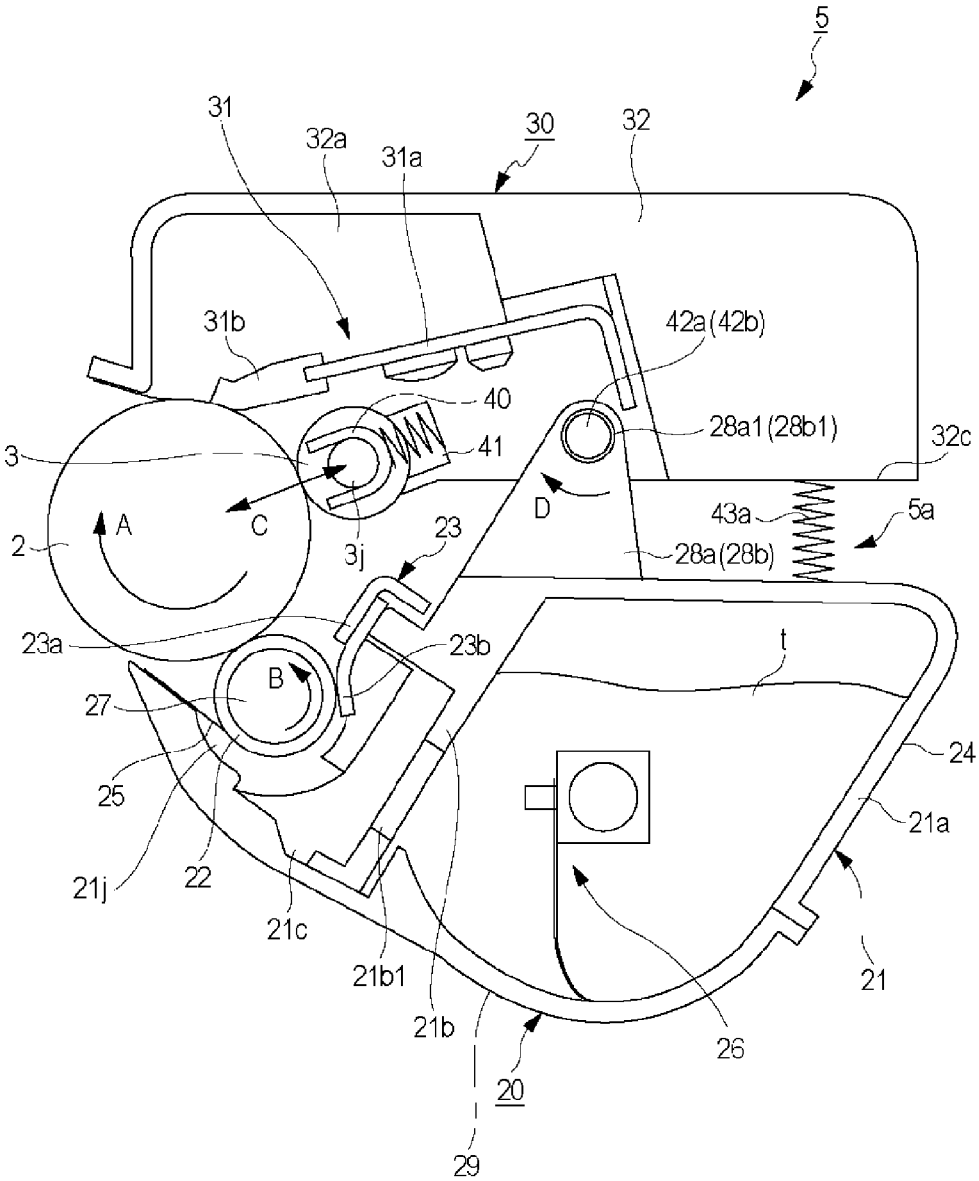
FIG. 3 is a sectional, structural view of the process cartridge in Embodiment 1.

Next, a process cartridge 5, detachably mountable to the image forming apparatus main assembly in this embodiment, will be described with reference to FIG. 3.

The cartridge 5 includes a photosensitive member unit 30 as a first unit, including the photosensitive drum 2, the charging roller (charging means) 3 and a cleaning means (hereafter referred to as a cleaning blade) 31. Further, the cartridge 5 is divided into the photosensitive member unit 30 and a developing (device) unit (developing device) 20 as a second unit, including the developing roller (developer carrying member) 22.

Figure 12:
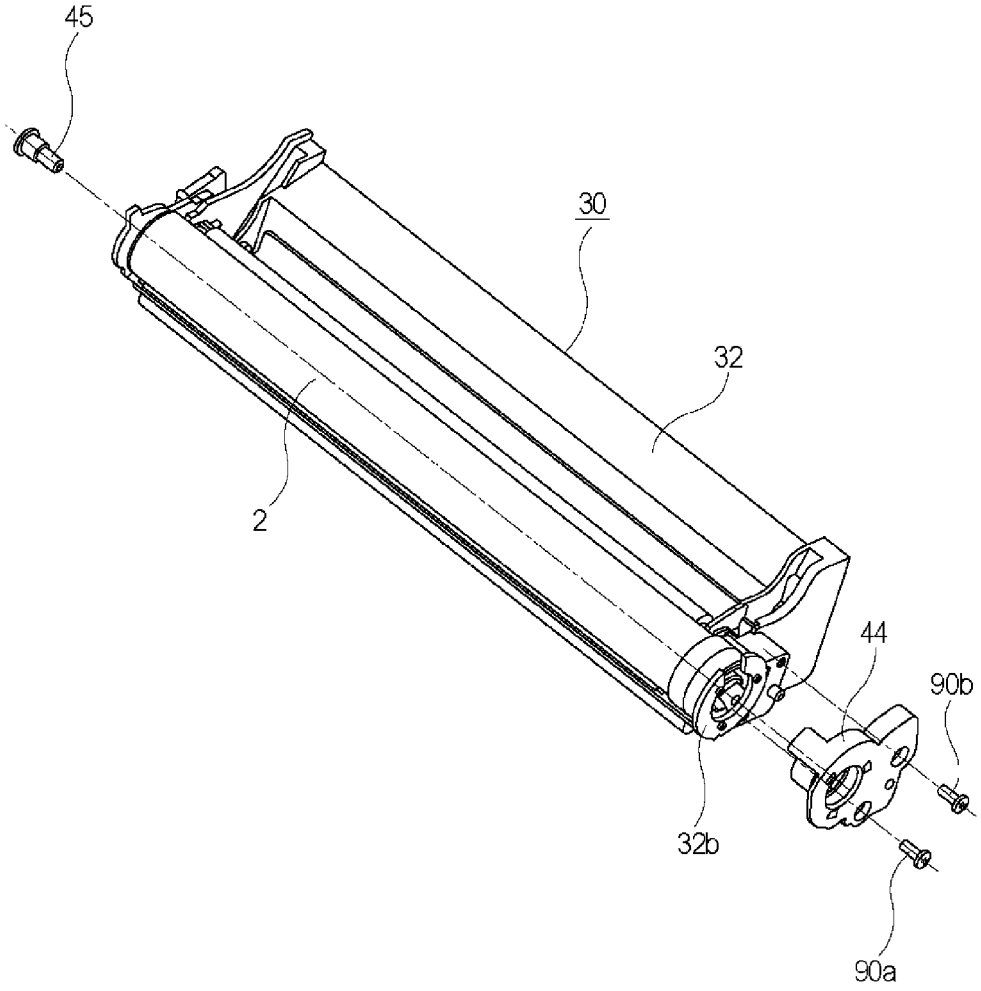

To a cleaning means (blade) frame 32 of the photosensitive member unit 30, the photosensitive drum 2 is rotationally mounted via a drum bearing 44 (FIG. 12) and a positioning pin 45 (FIG. 12). Further, by transmitting a driving force of a driving motor (not shown) to the photosensitive member unit 30, the photosensitive drum 2 is rotationally driven in the arrow A direction, depending on an image forming operation. On a peripheral surface of the photosensitive drum 2, as described above, the charging roller 3 and the cleaning blade 31 are disposed.

Here, the cleaning blade 31 is constituted by a cleaning member 31*b* integrally molded with or bonded to a blade supporting portion 31*a*. Then, this cleaning member 31*b* is contacted to the photosensitive drum 2 to scrape off the toner remaining on the surface of the photosensitive drum 2. Then, the residual toner that is scraped off is accommodated in a residual toner accommodating portion 32*a*.

To the cleaning means frame 32, a charging roller bearing 40 is mounted movably in an arrow C direction passing through the center of the charging roller 3 and the center of the photosensitive drum 2. A shaft 3*j* of the charging roller 3 is rotatably mounted to the charging roller bearing 40. Further, the bearing 40 is in a state in which it is urged toward the photosensitive drum 2 by a charging roller urging member 41.

The developing unit 20 includes a developer accommodating container for accommodating a magnetic one-component developer (toner), substantially consisting of magnetic resin toner particles (which may contain an external additive).

The developer accommodating container 21 is contacted by fixing a developing device frame 24 that forms a developer accommodating portion 21*a*, supports a stirring means 26, and accommodates therein the toner t and a developer container cover (toner container cover) 29 through an ultrasonic weld. Further, the developer accommodating container 21 is partitioned into the developer accommodating portion 21*a* and a developing chamber 21*c*, and the developer accommodating portion 21*a* and the developing chamber 21*c* communicate with each other via a supply opening as a first opening of a partitioning portion 21*b*.

In the developing unit 20, the developing roller 22, for forming a visible image by supplying with the toner the electrostatic latent image formed on the photosensitive drum 2, is disposed. Further, in the developing unit 20, a developer layer thickness regulating means (hereafter referred to as a developing blade) 23 for imparting triboelectric charges to the toner, to form a toner layer on the surface of the developing roller 22, and a like member, are disposed.

Further, at a lower-portion opening 21*j*, between the developing roller 22 and the toner container cover 29 for forming the developing chamber 21*c*, a leakage preventing sheet 25 for sealing the lower-portion opening 21*j* is provided, thus preventing leakage of the toner toward a downward direction of the developing roller 22.

The toner in the developer accommodating portion 21*a* is sent to the developing roller 22 by rotation of the stirring means 26.

Then, the triboelectric charges are imparted to the toner by the developing roller 22, which incorporates a fixed magnet 27 and rotates in an arrow B direction and by a developer layer thickness regulating member 23*b*, which is integrally molded with or bonded to a blade supporting portion 23*a* of the developing blade 23. At the same time, the developer layer thickness regulating member 23*b* forms a toner layer, subjected to layer thickness regulation, on the surface of the developing roller 22.

Figure 4:
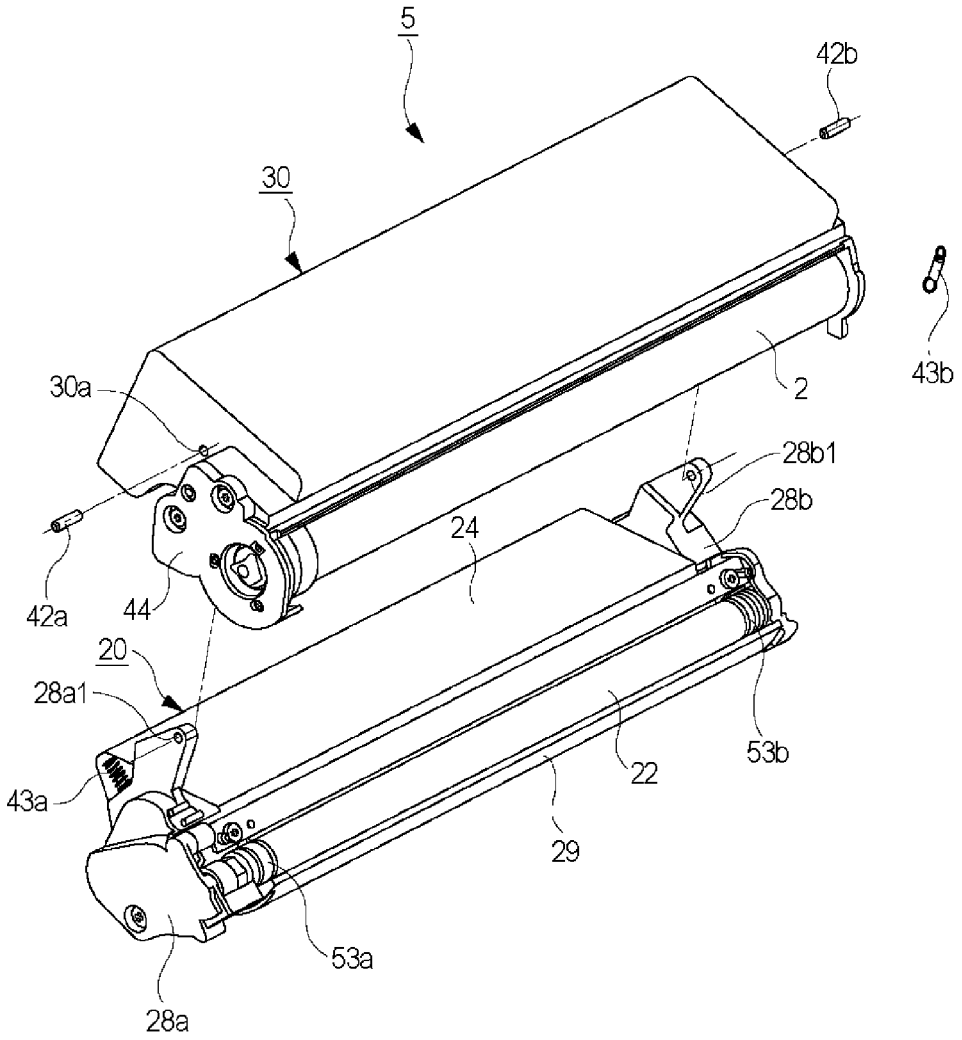
FIG. 4 is an exploded perspective view of the process cartridge in Embodiment 1.

As shown in FIG. 4, the developing roller 22 is rotatably supported by the developer accommodating container 21 via developing device bearings 28 (28*a*, 28*b*), mounted at longitudinal ends of the developer accommodating container 21, respectively.

Further, the developing roller 22 is provided with spacer rollers 53 (53*a*, 53*b*) as a space-holding member rotatably supported at its end portions, in order to keep a certain clearance with respect to the photosensitive drum 2 (FIG. 4).

Further, the developing unit 20 is connected rotatably with the photosensitive member unit 30 around connecting shafts 42 (42*a*, 42*b*), as a connecting member engageable in holes 28*a*1 and 28*a*2 provided in the developing device bearings 28*a* and 28*b*. The developing unit 20 is urged by urging springs 43.

With respect to an axial direction of the photosensitive drum 2, a compression urging spring 43*a*, provided at one end side, is disposed opposite from the photosensitive drum 2 with respect to the connecting shaft 42, which is the rotation center of the developing unit 20 relative to the photosensitive member unit 30. This compression urging spring 43*a* is a compression spring for urging the photosensitive member unit 30 and the developing unit 20.

Figure 5:
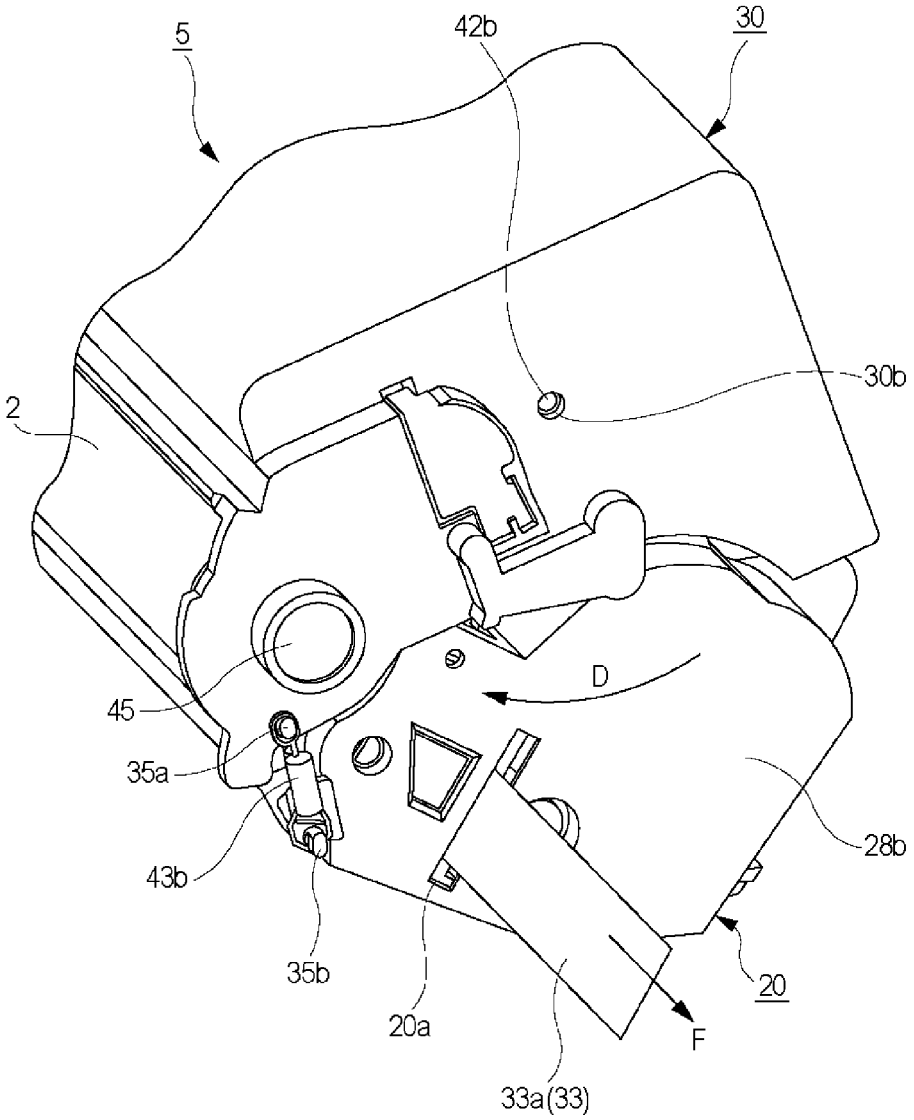
FIG. 5 is a perspective view showing an urging constitution of a developing unit at the other end side of the process cartridge in Embodiment 1.

A tension urging spring 43*b* provided at the other end side is disposed in the neighborhood of the photosensitive drum 2 of the photosensitive member unit 30 and in the neighborhood of the developing roller 22 of the developing unit 20. The tension urging spring 43*b* is stretched by stretching bosses 35*a* and 35*b* provided on the photosensitive member unit 30 and the developing unit 20, respectively, at the other end side (FIG. 5).

For that reason, the developing unit 20 is rotated around the connecting shaft 42, as the center in an arrow D direction (FIG. 3), to urge the developing roller 22 toward the photosensitive drum 2, so that the toner layer formed on the developing roller 22 is supplied to a developing region of the photosensitive drum 2.

Then, the toner is transferred onto the photosensitive drum 2, depending on the electrostatic latent image formed on the photosensitive drum 2, so that the toner image is formed.

When the cartridge 5 is properly mounted in the apparatus main assembly 1*a* (FIG. 2), contacts (not shown) at the apparatus main assembly side and the cartridge side are electrically connected. Thus, the cartridge 5 is in a state in which a predetermined charging bias and a predetermined developing bias are applicable from a voltage applying means (not shown), provided in the apparatus main assembly 1*a*, to the charging roller 3 and the developing roller 22, respectively.

Further, similarly, when the cartridge 5 is properly mounted in the apparatus main assembly (FIG. 2), drive transmitting portions (not shown) at the apparatus main assembly side and the cartridge side are connected. Thus, the process cartridge 5 is in a state in which a driving force from a driving means (not shown), such as a driving motor provided in the apparatus main assembly 1*a*, is transmittable to the cartridge 5.

In this embodiment, the driving force of the driving motor provided in the apparatus main assembly (FIG. 2) is transmitted to the photosensitive drum 2, and then, is transmitted to the developing roller 22 and the stirring means 22, and the like, via drive transmitting portions such as gear trains.

Incidentally, via the drive transmitting portions provided at the apparatus main assembly side and the cartridge side, a driving means, for independently driving each element, such as the stirring means 26, can be independently provided in the apparatus main assembly 1*a*.

Figure 6:
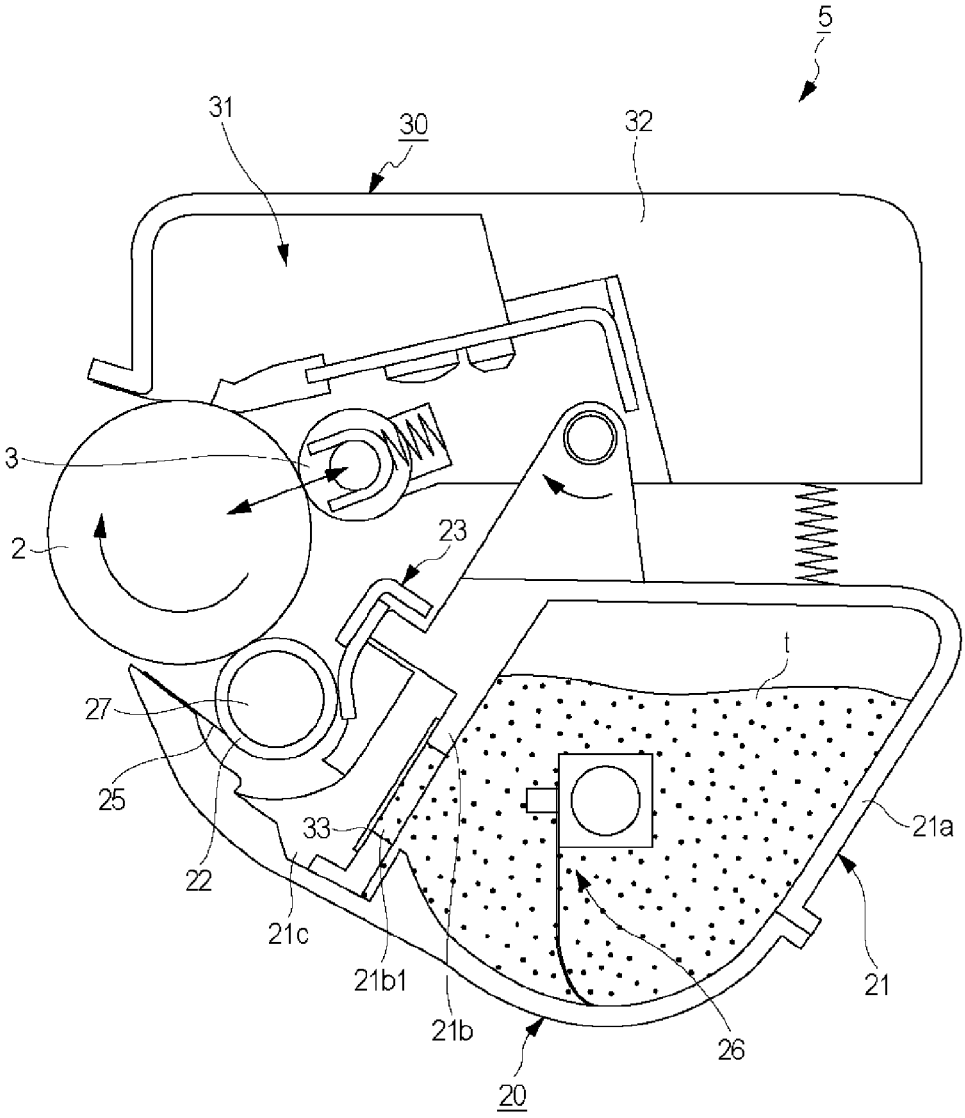
FIG. 6 is a sectional view of the process cartridge in Embodiment 1 in a state in which a toner supply opening of the process cartridge is sealed with the toner seal.

The process cartridge 5 to be shipped from a factory, in an unused and brand new state, is sealed with a flexible seal member (hereafter referred to as a toner seal), at a toner supply opening 21*b*1 for permitting supply of the toner t from the developer accommodating portion 21*a* to the developing roller 22, as shown in FIG. 6. That is, the toner t is filled in a constant amount only in the developer accommodating portion 21*a*, and is not present in the developing chamber 21*c*.

Figure 7:
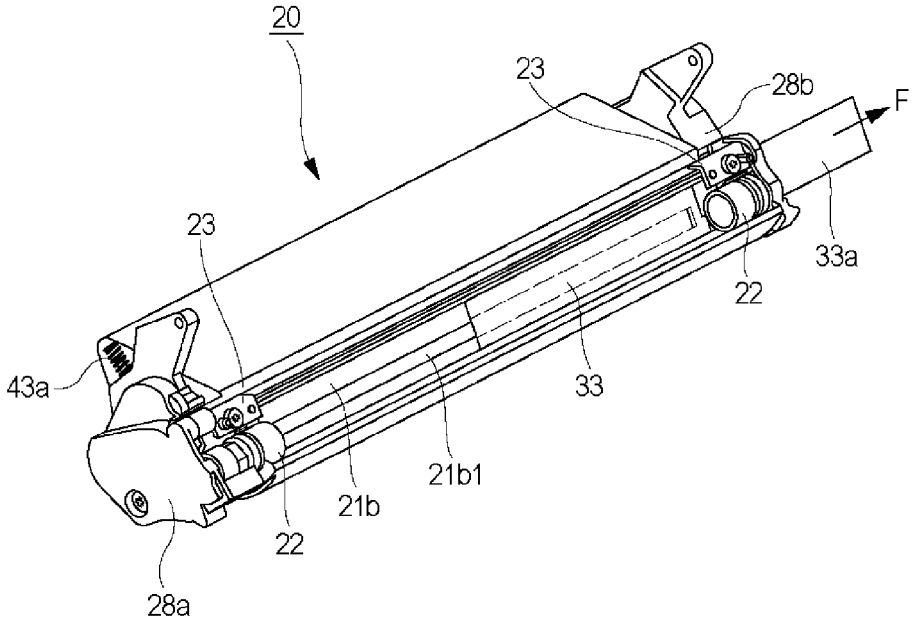
FIG. 7 is a perspective view showing a state in which the toner seal for the process cartridge in Embodiment 1 is being removed to unseal the toner supply opening.
Figure 8:
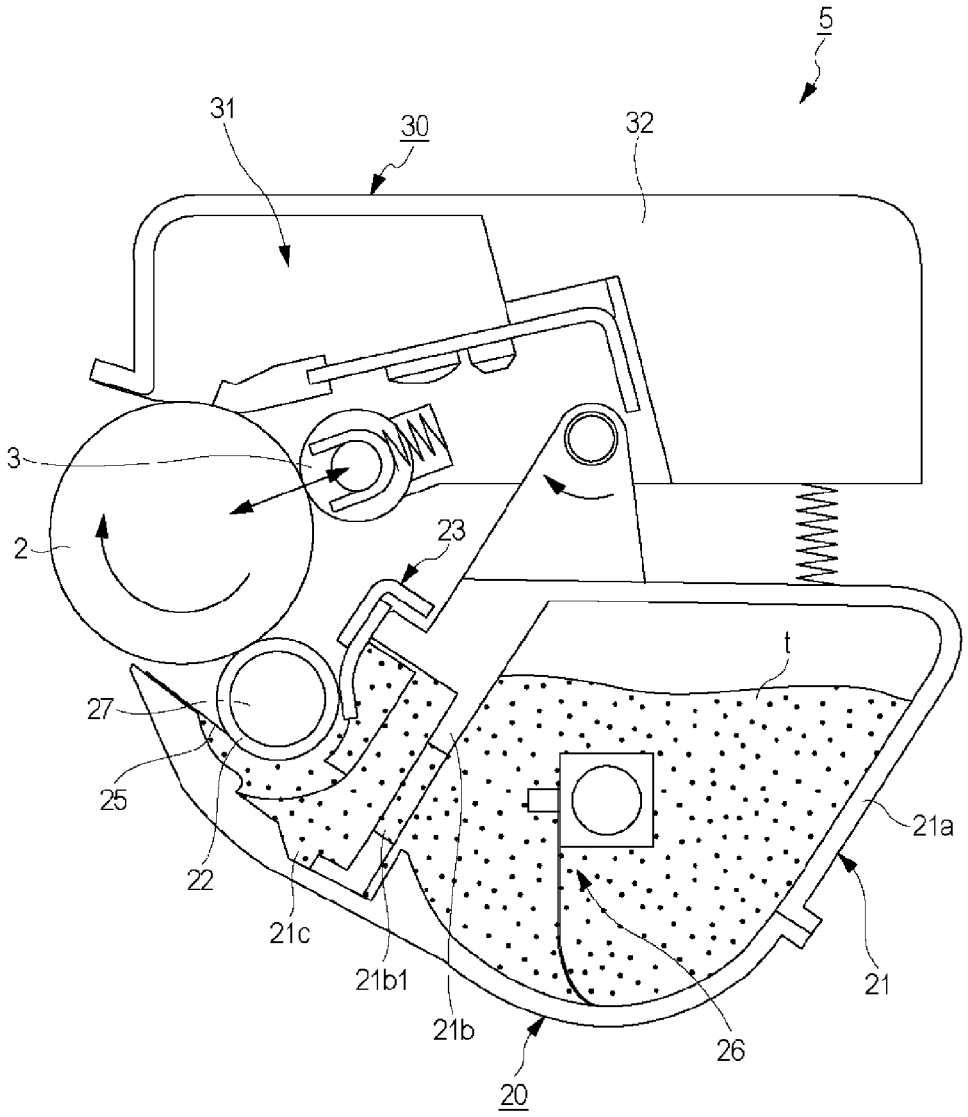
FIG. 8 is a sectional view showing a state in which the toner supply opening of the process cartridge in Embodiment 1 is unsealed and a toner in a developer accommodating portion flows into a developing chamber.

A user holds, with fingers, a toner seal pulling-out holding portion 33*a* exposed from a toner seal pulling-out hole 20*a* provided in the developing unit 20 at one end side of the cartridge 5, as shown in FIG. 5, when the cartridge 5, in the unused and brand-new state, is used. Then, the user pulls the toner seal 33 in an arrow F direction. FIG. 7 shows a state in which the toner seal pulling-out holding portion 33*a* is pulled in the arrow F direction and, thus, the toner seal 33 is being demounted from the cartridge 5 thereby to unseal (open) the toner supply opening. Incidentally, in FIG. 7, for explanation, the developing roller 22 is omitted. By completely removing the toner seal 33, the toner seal 33 is removed from the cartridge 5. As a result, the toner supply opening 21*b*1 is unsealed (opened) over the full-length portion thereof, so that the toner t in the developer accommodating portion 21*a* flows into the developing chamber 21*c*, as shown in FIG. 8. Thus, the toner seal 33 is removed, and, then, the cartridge 5 with the unsealed toner supply opening 21*b*1 is mounted in the apparatus main assembly 1*a*, to be used.

Figure 9:
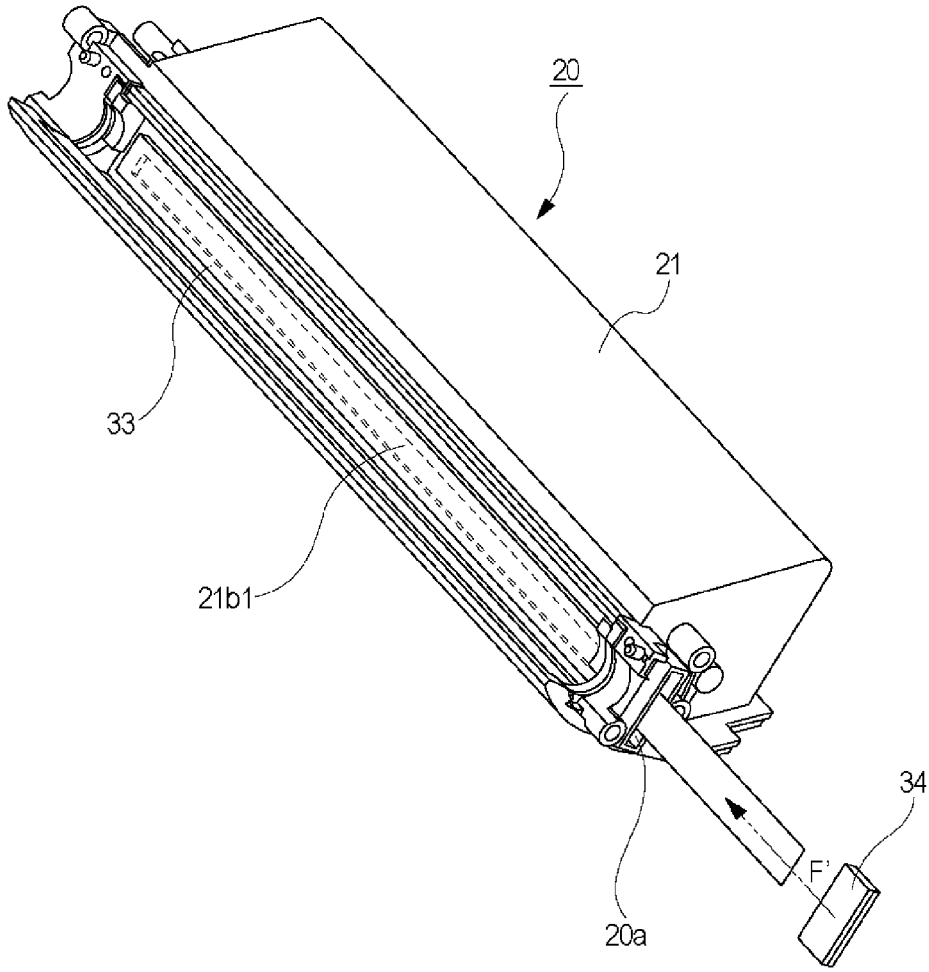
FIG. 9 is a perspective view illustrating a sealing method of a toner leakage preventing seal for the process cartridge in Embodiment 1.

As shown in FIG. 9, in the toner seal pulling-out hole 20*a* of the developer accommodating container 21, a toner leakage preventing seal 34, inserted from an arrow F' direction to the pulling-out direction F of the toner seal 33, is provided. The toner leakage preventing seal 34 prevents the toner leakage from the toner seal pulling-out hole 20*a* during and after the toner seal removal.

As the toner seal 33, an integral member of a base material of biaxially oriented polyester, oriented (stretched) polypropyrene, or the like, with a sealant layer of ethylene vinyl acetate copolymer, is used.

Figure 10:
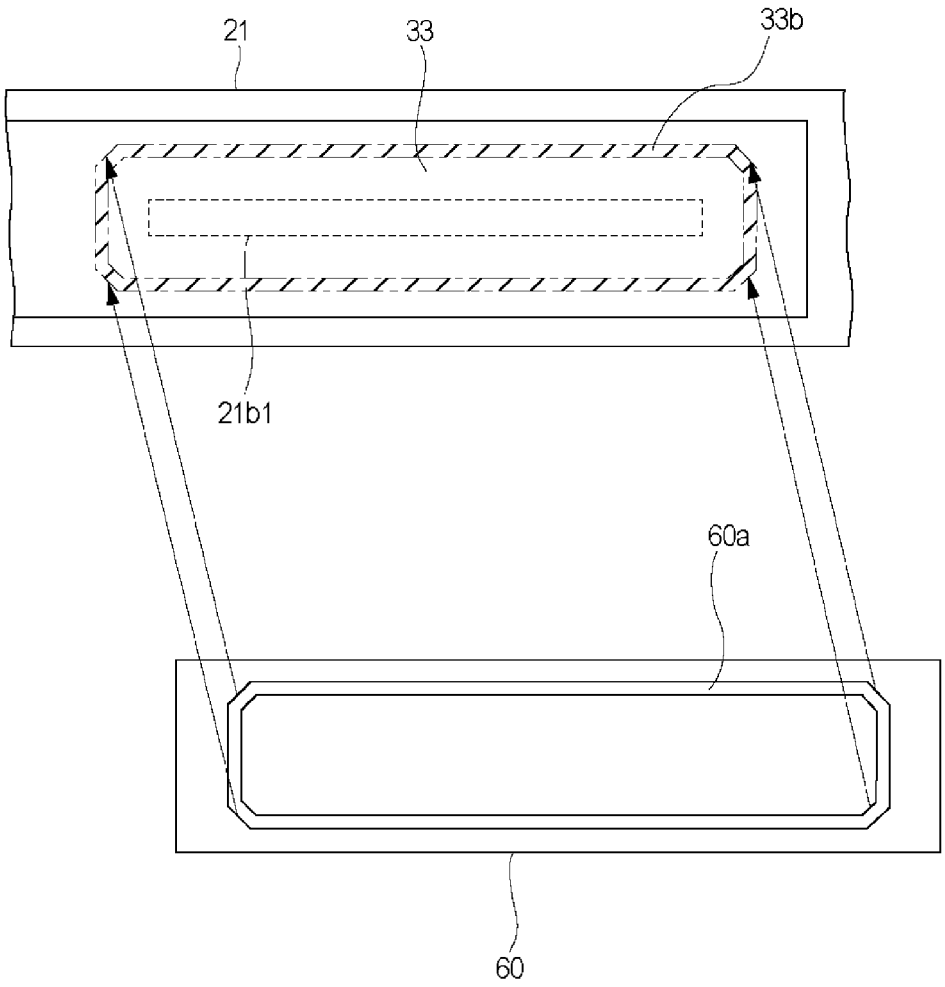
FIG. 10 is an illustration of a welding method when the process cartridge in Embodiment 1, in an unused and brand-new state, is sealed with the toner seal.

As shown in FIG. 10, the toner seal 33 is subjected to thermocompression bonding at a periphery of the toner supply opening 21*b*1, to weld the sealant layer thereof, thus, being fixed on the developer accommodating container 21. As a welding condition, the thermocompression bonding is performed, by, e.g., thermally compressing a seal bar 60*a* of a horn 60, under a condition of about 130° C. to 160° C. in temperature, 0.1 MPa to 4 MPa in pressure, and about 1 sec to 5 sec in bonding time, in a hatched region enclosed by a chain double-dashed line extending around the entire periphery of the toner supply opening 21*b*1. As a result, fixing between the toner seal 33 and the developer accommodating container 21, and sealing of the toner seal 33, are effected.

Incidentally, in a case when the thermocompression bonding is performed by using the seal bar 60*a*, the toner seal 33 and the seal bar 60*a* have to be uniformly press-contacted in parallel to each other. When this press-contact is non-uniform, excessive stress is exerted on the toner seal 33, so that there is a possibility that the toner seal 33 is broken from its fixed portion on the developer accommodating container 21, in the case when an impact is applied to the cartridge, or the cartridge is dropped.

Next, deformation of the bonding (welding) portion between the toner seal 33 and the developer accommodating container 21, to which the toner seal 33 is bonded, will be described with reference to FIG. 11. Part (a) of FIG. 11 is a sectional view showing a state before the toner seal 33 is heat-sealed on the developer accommodating container 21, and part (b) of FIG. 11 is a sectional view showing a deformed state of the developer accommodating container 21, after the toner seal 33 is heat sealed on the developer accommodating container 21.

A bonding procedure of the toner seal 33 on the developer accommodating container 21 will be described.

First, the developer accommodating container 21 is disposed so that the toner supply opening 21*b*1 of the developer accommodating container 21 and the seal bar 60*a* of the horn 60 are located at their opposing positions. Then, between the horn 60 and the developer accommodating container 21, the toner seal 33 is disposed so as to cover the toner supply opening 21*b*1.

Then, the horn 60 is moved toward the developer accommodating container 21 so that the toner seal 33 is interposed between the developer accommodating container 21 and the horn 60, and the seal bar 60*a* of the horn 60 is press-contacted to the toner seal 33 toward the developer accommodating container 21 under the condition described above. Thereafter, the press-contact between the horn 60 and the toner seal 33 (on the developer accommodating container 21) is released, so that the fixing of the toner seal 33 is completed.

During the welding of the toner seal 33, by the heat of the seal bar 60*a*, not only the sealant layer of the toner seal 33, but also, the developer accommodating container 21 in the neighborhood of a pressure-receiving portion 21*d* where the toner seal 33 receives the pressure from the seal bar 60*a*, are melted. At this time, a melted portion of the developer accommodating container 21 receives the pressure from the seal bar 60*a* and, therefore, is shifted toward its sides, so as to escape from the pressure.

As a result, at the seal portion of the developer accommodating container 21 after the heat seal, an outside projection 21*e*1 and an inside projection 21*e*2, formed by solidification of the melted portion shifted to the both sides of the pressure-receiving portion 21*d* facing the seal bar 60*a*, are created.

For that reason, when the toner seal 33 is pulled out for use of the cartridge, a welding trace formed by the pressure-receiving portion 21*d*, the outside projection 21*e*1, and the inside projection 21*e*2 remains on the surface of the partitioning portion 21*b* at the periphery of the toner supply opening 21*b*1 (FIG. 21).

(Remanufacturing Method of a Cartridge)

In the cartridge 5 mounted and used in the apparatus main assembly 1*a*, the toner t contained in the developer accommodating portion 21*a* is consumed in accordance with the repetition of the image formation. Then, when the toner t is consumed to the degree it becomes impossible to form the image of the quality that satisfies the user of the cartridge 5, it loses commercial value as the cartridge 5.

The used-up process cartridge 5 is collected, and the cleaning, the parts replacement, and so on, are carried out, and fresh toner is filled thereinto, thus being remanufactured in some cases. The remanufacturing method of the used-up cartridge will be described below.

(i) Unit Separating Step:

A separating step for separating the photosensitive member unit 30 and the developing unit 20 of the cartridge 5 will be described with reference to FIGS. 4 and 5.

The tension urging spring 43*b*, which urges the developing roller 22 toward the photosensitive drum 2, is removed. Then, the connecting shafts 42 (42*a*, 42*b*), which rotatably connect the photosensitive member unit 30 and the developing unit 20, are pulled out. By the step described above, the engagement between the photosensitive member unit 30 and the developing unit 20 is entirely released, so that the photosensitive member unit 30 and the developing unit 20 are separable.

(ii) Disassembling, Cleaning, Parts Replacement, Reassembling of Photosensitive Member Unit:

After separating the photosensitive member unit 30, disassembling, cleaning, parts replacement, and reassembling of the photosensitive member unit 30 will be described with reference to FIGS. 12 to 15.

The photosensitive drum 2 is held via the drum bearing 44 provided at one end of the cleaning means frame 32, and via the positioning pin 45 provided at the other end of the cleaning means frame 32. As shown in FIG. 12, first, screws 90*a* and 90*b*, which fix the drum bearing 44 on the cleaning means frame 32, are removed, so that the drum bearing 44 is removed from the cleaning means frame 32. Further, the positioning pin 45 is pulled out from the cleaning means frame 32. As a result, the photosensitive drum 2 is placed in a state in which it can be received by a C-shaped hole providing portion 32*b*, so that it becomes possible to easily dismount the photosensitive drum 2 from the cleaning means frame 32. When the photosensitive drum 2 is removed along a sliding portion of the C-shaped hole providing portion 32*b*, the user does not directly touch the photosensitive layer surface of the photosensitive drum 2 and, therefore, it is possible to prevent contamination of the photosensitive drum 2 by the touch.

Figure 13:
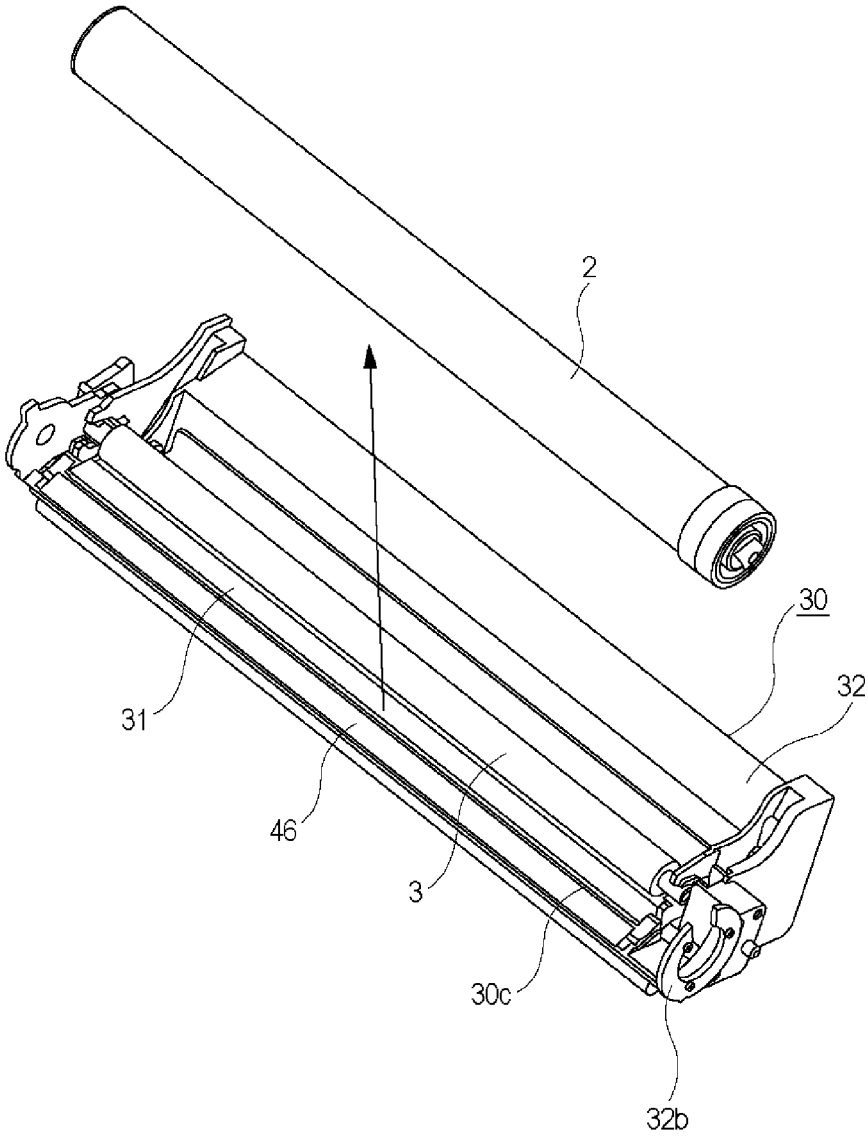
Figure 14:
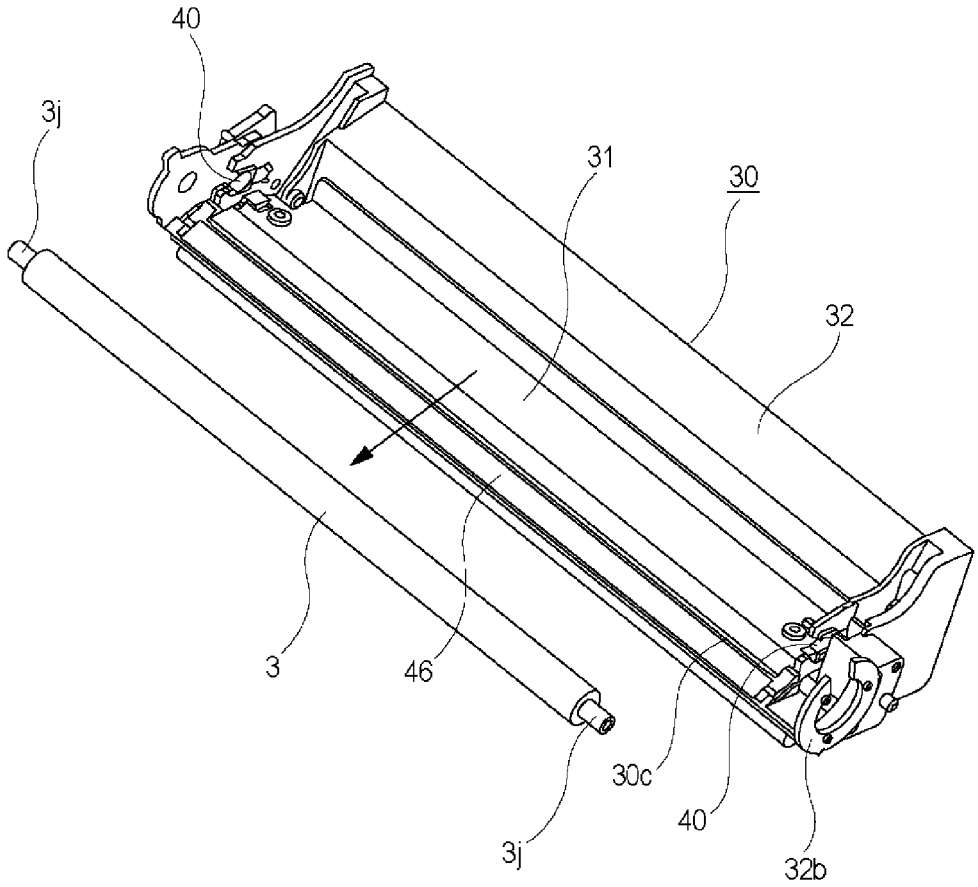

As shown in FIG. 13, when the photosensitive drum 2 is disassembled from the cleaning means frame 32, an elongated residual (waste) toner collection opening 30*c* is exposed between the cleaning blade 31, mounted on the cleaning means frame 32, and a residual (waste) toner leakage preventing sheet 46. As a result, the removal of the residual toner stored in the cleaning means frame 32 can be accomplished using the residual toner collection opening 30*c*. The removal is carried out by air suction, blowing, wet type cleaning, and wiping, for example. As shown in FIG. 14, the dismounting of the charging roller 3 is made by being dismounted from charging roller bearings 40 that support longitudinal ends of the charging roller 3. At this time, when the charging roller 3 is dismounted from the cleaning means frame 32 by holding a shaft 3*j* thereof at its longitudinal ends, the user does not directly touch the charging roller 3 and, therefore, it is possible to prevent contamination of the charging roller 3 by the touch. Incidentally, in a state in which the charging roller 3 is dismounted, when the removal of the residual toner is carried out, the contamination and the damage of the charging roller 3 at the time of the removal can be prevented.

Figure 15:
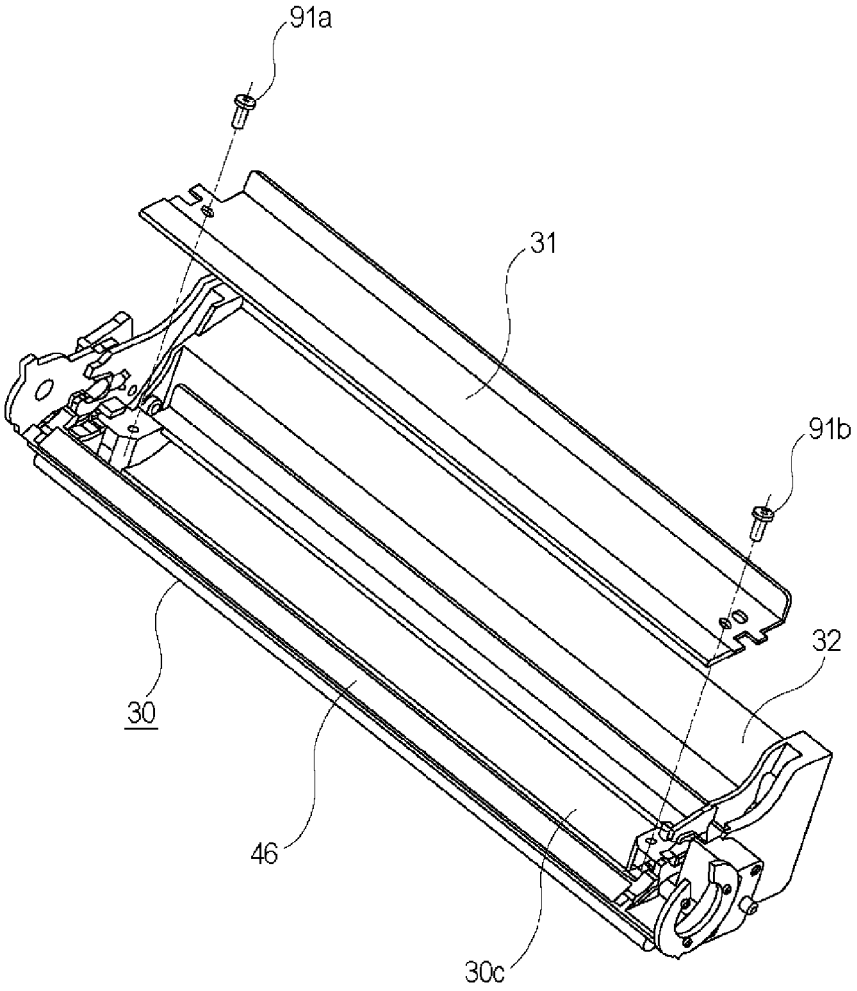

As shown in FIG. 15, the dismounting of the cleaning blade 31 is enabled by dismounting the screws 91*a* and 91*b* that fix the cleaning blade 31 on the cleaning means frame 32.

In a state in which the cleaning blade 31 is dismounted, when the removal of the residual toner is carried out, it is possible to prevent the contamination and the damage (breakage) of the cleaning blade 31 at the time of the removal. Further, the residual toner collection opening 30*c* is enlarged and, therefore, a removal efficiency can also be improved. Further, cleaning of the charging roller 3 and the cleaning blade 31 is carried out as desired.

Further, by reversing the procedure in the case of the disassembling described above, reassembling of the photosensitive member unit 30 is carried out. That is, the mounting of the cleaning blade 31, the charging roller 3, and the photosensitive drum 2 is carried out by this procedure. In this case, with respect to at least the photosensitive drum 2, a brand-new photosensitive drum 2 is used, and temporarily placed on the C-shaped hole providing portions 32*b* of the cleaning means frame 32, and then, the drum bearing 44 and the positioning pin 45 are mounted to the cleaning means frame 32.

By the steps described above, the reassembling of the photosensitive member unit is completed.

(iii) Disassembling, Cleaning, Parts Replacement, and Reassembling of Developing Unit:

After separating the developing unit 20, disassembling, cleaning, parts replacement, and reassembling of the developing unit 20 will be described with reference to FIGS. 1 and 16 to 20.

First, with reference to FIG. 16, disassembling of the developing unit 30 at one end side will be described.

First of all, a screw 92 that fixes the developing bearing 28*a* to the developing unit 20 is disassembled. As a result, the developing bearing 28*a* that is provided at one end side of the developing roller 22 and that supports the roller shaft 22*a* via a developing gear 47 is dismountable from the developing unit 20.

Next, the developing bearing 28*a* is dismounted from the developing unit 20, so that idler gears 48*a* and 48*b* for transmitting the driving force of the developing gear 47 to the stirring means 26 (FIG. 3) becomes easily dismountable.

By the above steps, the disassembling of the developing unit 20 at one end side is completed.

Next, the disassembling of the developing unit 20 at the other end side will be described with reference to FIG. 17.

First, a screw 93, which fixes the developing bearing 28*b* to the developing unit 20, is disassembled. As a result, the developing bearing 28*b*, which is provided at the other end side of the developing roller 22, and which supports the roller shaft 22*b*, is dismountable from the developing unit 20.

Next, the developing bearing 28*a* is dismounted from the developer accommodating container 21.

By the above steps, the disassembling of the developing unit 20 at the other end side is completed. As a result, a member for supporting the developing roller 22 is dismounted and, therefore, the developing roller 22 can be easily dismounted from the developing unit 20 (FIG. 18).

Next, a dismounting step of the developing blade 23 will be described with reference to FIG. 19.

The developing blade 23 is fixed to the developer accommodating container 21 at its longitudinal end portions with screws 94*a* and 94*b*. Therefore, the screws 94*a* and 94*b* are dismounted, and then the developing blade 23 is raised, so that the developing blade 23 is dismountable. Then, by dismounting the developing blade 23, the toner supply opening 21*b*1 for permitting the supply of the toner from the developer accommodating portion 21*a* to the developing roller 22 is exposed.

Further, the toner leakage preventing seal 34 provided in the toner seal pulling out hole 20*a* of the developer accommodating container 21 is pulled out from the developer accommodating container 21. Then, cleaning of the developer accommodating container 21, from which the developing roller 22, the developing blade 23 and the toner leakage preventing seal 34 are dismounted, is carried out.

Next, a toner re-filling step will be described with reference to FIG. 20.

This step is performed while holding the developing unit 20, so that the exposed toner supply opening 21*b*1 of the developer accommodating container 21 for reuse prepared by the above-described disassembling step is directed upward, and so that the developer accommodating portion 21*a* is directed downward. Then, an end of a funnel 16 is inserted into the toner supply opening 21*b*1 and then the toner is dropped from a toner container (bottle) (not shown), or the like, so that re-filling of the toner is carried out.

Figure 1:
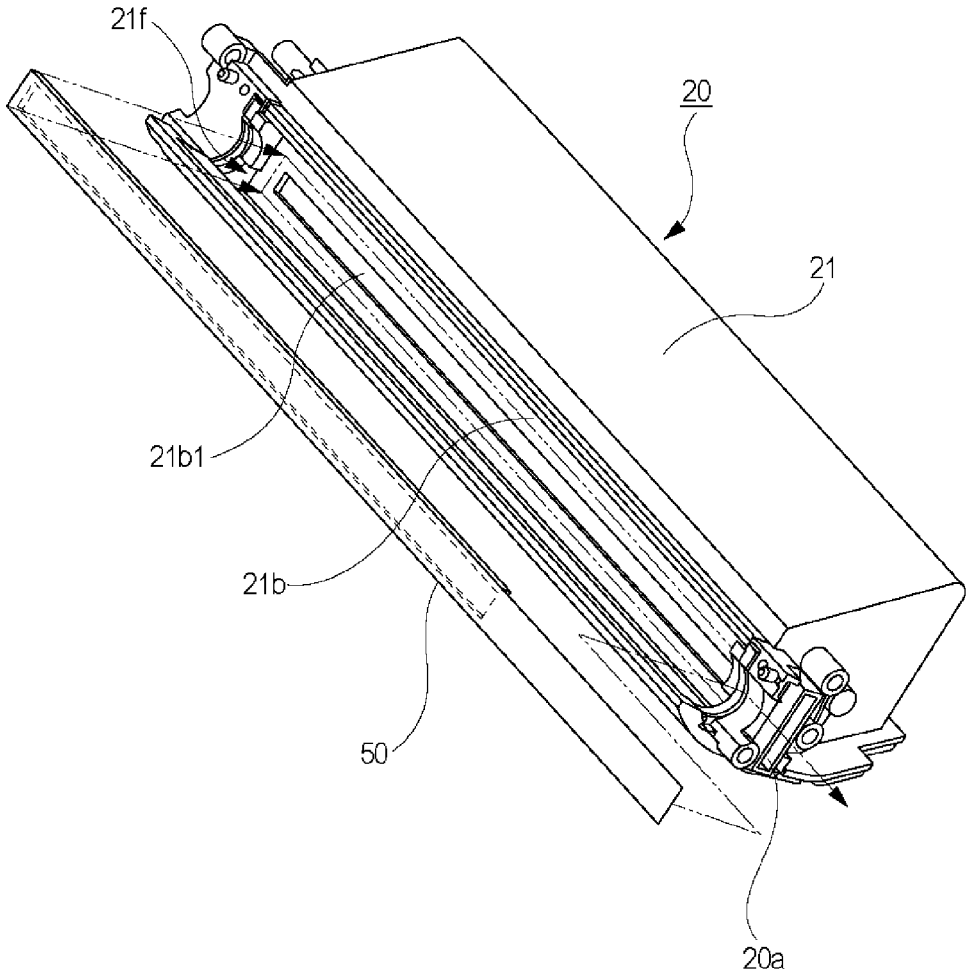
FIG. 1 is a perspective view illustrating a sealing method of a toner seal for a process cartridge in Embodiment 1.

Then, after the toner is re-filled into the developer accommodating portion 21*a* through the toner supply opening 21*b*1, a seal unit 50 (described later) is inserted into a recessed portion 21*f*, from a direction in which it opposes the toner supply opening 21*b*1, so as to cover (seal) the toner supply opening 21*b*1. As a result, the toner supply opening 21*b*1 is sealed, similarly as in the brand-new state (FIG. 1).

In a case when the toner supply opening 21*b*1 is sealed, similarly as during the unused and brand-new state, the sealing is possible, even when the toner seal is fixed again on the developer accommodating container by direct welding.

However, in the fixing method by the welding, as shown in FIG. 12, after the removal of the toner seal, the welding trace formed by the pressure-receiving portion 21*d*, the outside projection 21*e*1, and the inside projection 21*e*2 remains at the toner seal fixing portion on the surface of the partitioning portion 21*b*.

That is, in the fixing method using the heat seal, the fixing portion of the partitioning portion 21*b* is deformed when the toner supply opening 21*b*1 is sealed.

For this reason, when the heat seal is carried out again at the deformed portion, due to undulations at the deformed portion, the developer accommodating container 21 is not readily intimately contacted to the toner seal or the plate-like member and, therefore, there is a possibility that the connection between the members becomes incomplete.

Therefore, in the case when the heat seal is used, the heat seal has to be fixed in an undeformed region, such as an outside of the pressure-receiving portion between the developer accommodating container 21 and the toner seal in the unused and brand new (fresh) state.

Accordingly, in the fixing method using the heat seal, as shown in FIG. 22, e.g., a fixing portion 61*b* for a second time has to be disposed outside of a fixing portion 61*a* for a first time, as seen from the toner supply opening 21*b*1. Further, with a larger set number of times of remanufacturing, the partitioning portion 21*b* has to be made larger, so that the cartridge becomes large, which leads to enlarging of the apparatus.

Therefore, in this embodiment, as shown in FIG. 23, the toner supply opening 21*b*1 is sealed by using the seal unit 50.

Here, an assembling method of the seal unit 50 and a bonding method of the seal unit 50 on the developer accommodating container 21 will be described.

First, a plate-like member 51*a*, an adhesive member 51*b*, and a seal film 52 are prepared.

Here, as the plate-like member 51*a*, a plate of plastic (thermoplastic resin), such as a polyester plate, a polyethylene plate, a nylon plate, or an ABS plate, prepared by being sheet-molded to a thickness of about 0.3 to about 2 mm is used. Further, as the adhesive member 51*b*, a bonding agent, an adhesive agent, a double-coated tape, or the like, is used. Further, as the seal film 52, which is a re-seal member, an integral member including a biaxially oriented polyester, oriented polypropylene, or the like, as a base material and including ethylene-vinyl acetate copolymer as a sealant layer, is used.

Next, the adhesive member 51*b* is bonded on the plate-like member 51*a*. Then, the bonded members are subjected to blanking (punching) in a quadrilateral shape by press working, or the like, so that an opening 50*a* as a second opening and an outer portion 50*b* are molded to prepare a base material 51.

Then, the seal film 52 is molded in a strip shape corresponding to a size of the base material 51. Next, the seal film 52 is bonded on a periphery of the opening 50*a* by thermocompression bonding to weld the sealant layer of the seal film 52, thus, being fixed on the base material 51 to prepare a unit. Under a welding condition of, e.g., about 130° C. to 160° C. in temperature, 0.1 MPa to 4 MPa in pressure, and about 1 sec. to 5, sec in bonding time, the seal bar 60*a* of the horn 60 is subjected to the thermocompression bonding to fix the seal film 52 on the base material 51. In this case, at one longitudinal end portion of the seal film 52, an extension fold-back portion 52*a* is provided, so that the seal film 52 is longer than the base material 51 when the seal film 52 is folded back toward the welding side, and then, is welded on the base material 51. Here, the extension fold-back portion 52*a* is a free end and its free end portion 52*b* constitutes a holding portion at the time of dismounting the seal film 52.

Then, the thus-unitized seal unit 50 is inserted into the recessed portion 21*f* of the developer accommodating container 21, and the adhesive member 51*b* is bonded on the partitioning portion 21*b*, thus, effecting fixing of the seal unit 50 on the developer accommodating container 21 and hermetical sealing of the developer accommodating container 21 (FIG. 1).

Incidentally, in the case when the thermocompression bonding is carried out by the seal bar 60*a*, the seal film 52 and the seal bar 60*a* have to be uniformly press contacted to each other in parallel. This is because, when the press contact is non-uniform, excessive stress is exerted on the seal film 52 and thus, there is a possibility that the seal film 52 is torn from a fixing portion between the seal film 52 and the base material 51, in the case when an impact is applied to the cartridge, or the cartridge is dropped.

FIG. 24 shows a state in which the seal unit 50 is fixed on the developer accommodating container 21 and the toner supply opening 21*b*1 is sealed with the seal unit 50. After the seal unit 50 is fixed on the developer accommodating container 21, the free end portion 52*b* of the extension fold-back portion 52*a* of the seal film 52 is exposed toward the outside of the developing unit 20 through the toner seal pulling-out hole 20*a*. Into the toner seal pulling-out hole 20*a*, the toner leakage preventing seal 34 is inserted from a direction F' opposite to the pulling-out direction of the seal film 52. In this case, the toner leakage preventing seal 34 is replaced with a new one as needed.

As described above, by the heat and pressure during the welding of the toner seal as the sealing means at the time of the brand-new state, the outside projection 21*e*1 and the inside projection 21*e*2 are formed outside and inside of the pressure-receiving portion 21*d*, and the welding trace formed by the deformation of the toner seal remains at the partitioning portion 21*b*.

For this reason, as shown in FIG. 25, with respect to the toner supply opening 21*b*1, when the seal unit 50 is fixed on the developer accommodating container 21 in a state in which the seal unit 50 overlaps with the inside portion of the welding trace, the adhesive member 51*b* runs over the inside projection 21*e*2. At this time, the adhesive member 51*b* is not readily intimately contacted to a base portion of the inside projection 21*e*2, so that a gap E can be generated.

In such a state that the gap E is generated, and further, as shown in FIG. 26, when the adhesive member 51*b* of the seal unit 50 is bonded on the developer accommodating container 21 so as to cross the welding trace, through the gap E, an inside space and an outside space of the developer accommodating portion 21*b* (FIG. 3) communicate with each other. Therefore, a hermetical sealing property in the developer accommodating portion 21*a* cannot be retained, and when the cartridge undergoes vibration or impact at the time of falling during a transportation process, there is a possibility that the toner leakage from inside of the developer accommodating portion 21*a* in arrow G (G1, G2) is caused.

Further, by the presence of the gap E, when a bonding area of the adhesive member 51*b* is reduced, an adhesive strength is lowered and, therefore, there is a need to use an expensive seal that has a high adhesive strength, so as not to cause failing of the seal unit 50, when the cartridge undergoes vibration or impact at the time of falling during the transportation process.

Therefore, in this embodiment, as shown in FIG. 27, with respect to the toner supply opening 21*b*1, the outer portion 50*b* corresponding to an outermost edge portion of the adhesive member 51*b* of the seal unit 50 was disposed outside of the outside projection 21*e*1. The pressure-receiving portion 21*d*, the outside projection 21*e*1 and the inside projection 21*e*2 are welding traces of the toner seal formed on the developer accommodating container 21 at the time of the unused, brand-new state, and the outside projection 21*e*1 is an outermost edge portion of the welding traces.

As a result, the seal unit 50 is bonded on the developer accommodating container 21, so that the adhesive member 51*b* thereof does not cross the welding traces. For this reason, the seal unit 50 does not generate a gap, which communicates with the inside of the developer accommodating portion 21*a*, at a flat surface portion 21*h* outside the outside projection 21*e*1, as seen from the toner supply opening 21*b*1 of the developer accommodating container 21. Therefore, the seal unit 50 has a continuous bonding region, so that the hermetical sealing property in the developer accommodating portion 21*a* (FIG. 3) can be maintained.

In addition, a lowering in adhesive strength of the seal unit 50 with respect to the developer accommodating container 21 with a decrease in bonding area due to the generation of the gap can be prevented and, therefore, there is no need to use an expensive seal having high adhesive strength.

On the other hand, in this embodiment, the adhesive member 51*b* is used for fixing the seal unit 50 on the developer accommodating container 21.

As a result, in the case when the developer accommodating container 21, on which the seal unit 50 is bonded, is repeatedly used by being remanufactured, it is easy to remanufacture the developer accommodating container 21 by replacing the seal unit 50 with a new (fresh) seal unit 50. In addition, by using the seal unit 50, even when the remanufacturing is repeated, there is no need to enlarge the partitioning portion 21*b*. For that reason, the developer accommodating container 21 can be downsized, so that it is possible to reduce the size of the cartridge 5.

Further, in this embodiment, the plate-like member 51*a* and the adhesive member 51*b* of the seal unit 50 were made of the same shape.

As a result, for molding the plate-like member 51*a* and the adhesive member 51*b*, press working can be employed. In this press working, the plate-like member 51*a* and the adhesive member 51*b* can be molded simultaneously, so that productivity is improved.

As described above, with respect to the developer accommodating container 21, after the separation of the photosensitive member unit 30 and the developing unit 20, the longitudinal end developing bearings 28*a* and 28*b*, the developing roller 22, and the developing blade 23 are successively dismounted.

As a result, the toner supply opening 21*b*1 is opened and, therefore, the toner t can be refilled easily.

Then, after refilling the toner into the developer accommodating portion 21*a*, the developing unit 20 is assembled again. In the case of the reassembling of the developing unit 20, the operations may be carried out through a process that is opposite from the process of the disassembling step described above. More particularly, after the end of the refilling of the toner and the resealing of the toner supply opening with the seal unit 50, the developing blade 23, the developing roller 22, the developing gear 47, the developing bearings 28*a* and 28*b*, and the idler gears 48*a* and 48*b* are mounted to the developer accommodating container 21.

Through the above-described steps, the reassembling of the developing unit 20 is completed.

(iv) Unit Connection:

The photosensitive member unit 30 and the developing (device) unit 20, which are reassembled as described above, are rotatably connected to be reassembled as the cartridge. The unit connection will be described with reference to FIGS. 3, 4, and 5.

In order to rotatably connect the developing unit 20 with the photosensitive member unit 30, holes 28*a*1 and 28*b*1 of the developing bearings 28*a* and 28*b* provided in the developing unit 20 are positionally aligned with holes 30*a* and 30*b* of the photosensitive member unit 30. At this time, the compression urging spring 43*a* is urged against an urging spring-receiving surface 32*c* of the cleaning frame 32. In a state in which the above parts are positionally aligned, the connecting shafts 42 (42*a*, 42*b*) are inserted into the holes 30*a* and 30*b* of the photosensitive member unit 30 through the holes 28*a*1 and 28*b*1 of the developing bearings 28*a* and 28*b*.

Next, the tension urging spring 43*b* is stretched between urging spring stretching bosses 35*a* and 35*b* provided on the photosensitive unit 30 and the developing unit 20, respectively, at the other end side.

Through the steps described above, it is possible to provide a remanufacturing method of the cartridge that is free from leakage of the developer from the inside of the developer accommodating portion to the outside, even when the cartridge undergoes vibration or impact during the transportation process. Further, it is possible to provide simple remanufacturing methods of the developing device and the cartridge with general-purpose tools, without using dedicated tools.

In addition, it is possible to provide a remanufacturing method of the cartridge capable of re-commercializing the developing device and the cartridge that have commercial value, as the cartridge due to the consumption of the developer.

In addition, it is possible to provide remanufacturing methods of the developing device and the cartridge that realize simple refilling of the developer.

Incidentally, the above-described respective steps may be performed simultaneously by separate operators or may also be performed in appropriately changed orders.

Incidentally, in this embodiment, the used cartridges are collected, and disassembled. And, the parts taken out of the cartridges by the disassembling are gathered for same parts, respectively. Thereafter, the parts may be re-used, and in some cases, a portion of the parts (non-reusable part) may not be used, and a new part may instead be used. In addition, in another type of the present embodiment, the used cartridges are collected, and disassembled. And, a portion of parts (non-reusable parts) may not be used, and instead, a new part may be used, or a reusable part collected from another used cartridge may be reused.

[Embodiment 2]

Embodiment 2 will be described with reference to FIG. 28. Elements having substantially the same or corresponding structures and functions as those in Embodiment 1 are represented by the same reference numerals or symbols, and will be omitted from a detailed description.

In Embodiment 1, the outer portion 50*b* corresponding to the outermost edge portion of the seal unit 50 was disposed outside of the welding trace of the toner seal formed on the developer accommodating container 21 at the time of the unused brand-new state. Then, with respect to the toner supply opening 21*b*1, at the flat surface portion 21*h* outside of the welding trace, the continuous bonding region was provided between the seal unit 50 and the developer accommodating container 21.

In this embodiment, as shown in FIG. 28, with respect to the toner supply opening 21*b*1, the opening 50*a* corresponding to an innermost edge portion of the adhesive member 51*b* of the seal unit 50 was disposed inside of the inside projection 21*e*2. The inside projection 21*e*2 is an innermost edge portion of the pressure-receiving portion 21*d*, the outside projection 21*e*1 and the inside projection 21*e*2 that correspond to welding traces of the toner seal formed on the developer accommodating container 21 at the time of the unused, brand-new state.

As a result, the seal unit 50 is bonded on the developer accommodating container 21 so that the adhesive member 51*b* thereof does not cross the welding traces. For this reason, the seal unit 50 does not generate a gap, which communicates with the inside of the developer accommodating portion 21*a*, at a flat surface portion 21*g*, between the toner supply opening 21*b*1 and the inside projection 21*e*2, located inside of the inside projection 21*e*2 as seen from the toner supply opening 21*b*1 of the developer accommodating container 21. Therefore, the seal unit 50 has a continuous bonding region, so that the hermetical sealing property in the developer accommodating portion 21*a* (FIG. 3) can be maintained.

In addition, a lowering in adhesive strength of the seal unit 50 with respect to the developer accommodating container 21 with a decrease in bonding area due to the generation of the gap can be prevented and, therefore, there is no need to use an expensive seal having high adhesive strength.

On the other hand, in this embodiment, a size of the opening 50*a* was made to be not less than a size of the toner supply opening 21*b*1.

As a result, the seal unit 50 is inserted into the recessed portion 21*f* (FIG. 1) of the developer accommodating container 21, and the opening 50*a* and the toner supply opening 21*b*1 are positionally aligned at their opposing position, and then, the seal unit 50 is bonded on the partitioning portion 21*b*.

At that time, in a predetermined range, even when positional deviation during the bonding occurs, a portion of the toner supply opening 21*b*1 is not covered with the seal unit 50 and, therefore, there is no influence on a toner feeding property.

Further, in this embodiment, the adhesive member 51*b* is used for fixing the seal unit 50 on the developer accommodating container 21.

As a result, in the case when the developer accommodating container 21 on which the seal unit 50 is bonded is repeatedly used by being remanufactured, it is easy to remanufacture the developer accommodating container 21 by replacing the seal unit 50 with a new (fresh) seal unit 50. In addition, by using the seal unit 50, even when the remanufacturing is repeated, there is no need to enlarge the partitioning portion 21*b*. For that reason, the developer accommodating container 21 can be downsized, so that it is possible to reduce the size of the cartridge 5.

Further, in this embodiment, the plate-like member 51*a* and the adhesive member 51*b* of the seal unit 50 were made the same shape.

As a result, for molding the plate-like member 51*a* and the adhesive member 51*b*, press working can be employed. In this press working, the plate-like member 51*a* and the adhesive member 51*b* can be molded simultaneously, so that productivity is improved.

[Embodiment 3]

Embodiment 3 will be described with reference to FIG. 29. Elements having substantially the same or corresponding structures and functions as those in Embodiment 1 or 2 are represented by the same reference numerals or symbols, and will be omitted from a detailed description.

In Embodiment 1, the outer portion 50*b* corresponding to the outermost edge portion of the seal unit 50 was disposed outside of the welding trace of the toner seal formed on the developer accommodating container 21 at the time of the unused, brand-new state. Then, with respect to the toner supply opening 21*b*1, at the flat surface portion 21*h* outside of the welding trace, the continuous bonding region was provided between the seal unit 50 and the developer accommodating container 21.

Further, in Embodiment 2, the opening 50*a* corresponding to the innermost edge portion of the seal unit 50 was disposed inside of the welding trace of the toner seal formed on the developer accommodating container 21 at the time of the unused, brand-new state. Then, with respect to the toner supply opening 21*b*1, at the flat surface portion 21*g* inside of the welding trace, the continuous bonding region was provided between the seal unit 50 and the developer accommodating container 21.

In this embodiment, as shown in FIG. 29, with respect to the toner supply opening 21*b*1, the outer portion 50*b* corresponding to the outermost edge portion of the adhesive member 51*b* of the seal unit 50 was disposed outside of the outside projection 21*e*1 formed on the developer accommodating container 21 at the time of the unused, brand-new state. The outside projection 21*e*1 is an outermost portion of the pressure-receiving portion 21*d*, the outside projection 21*e*1, and the inside projection 21*e*2, which correspond to welding traces of the toner seal.

Further, with respect to the toner supply opening 21*b*1, the opening 50*a* corresponding to the innermost edge portion of the adhesive member 51*b* of the seal unit 50 was disposed inside of the inside projection 21*e*2 formed on the developer accommodating container 21 at the time of the unused, brand-new state. The inside projection 21*e*2 is an innermost portion of the pressure-receiving portion 21*d*, the outside projection 21*e*1, and the inside projection 21*e*2, which correspond to welding traces of the toner seal.

In this embodiment, the adhesive member 51*b* is not readily intimately contacted to base portions of the outside projection 21*e*1 and the inside projection 21*e*2 and, therefore, a gap can be generated between the developer accommodating container 21 and the adhesive member 51*b*. However, the seal unit 50 has the continuous bonding region at each of the flat surface portion 21*h* outside of the outside projection 21*e*1 and the flat surface portion 21*g* inside of the inside projection 21*e*2, as seen from the toner supply opening 21*b*1 of the developer accommodating container 21. Therefore, the gap through which the inside space and the outside space of the developer accommodating container 21 are communicated with each other is not generated and, thus, the hermetic sealing property in the developer accommodating portion 21*a* can be maintained.

In addition, spaces of the flat surface portions 21*b* and 21*g* are effectively used as the bonding region of the toner seal 50 and, therefore, the adhesive member 51*b* can be increased in size, so that a bonding force of the seal unit 50 to the developer accommodating container is enhanced and, thus, a sealing performance is further improved.

On the other hand, in this embodiment, a size of the opening 50*a* was made not less than a size of the toner supply opening 21*b*1.

As a result, the seal unit 50 is inserted into the recessed portion 21*f* (FIG. 1) of the developer accommodating container 21, and the opening 50*a* and the toner supply opening 21*b*1 are positionally aligned at their opposing position, and then, the seal unit 50 is bonded on the partitioning portion 21*b*.

At that time, in a predetermined range, even when positional deviation during the bonding occurs, a part of the toner supply opening 21*b*1 is not covered with the seal unit 50 and, therefore, there is no influence on a toner feeding property.

Further, in this embodiment, the adhesive member 51*b* is used for fixing the seal unit 50 on the developer accommodating container 21.

As a result, in the case when the developer accommodating container 21, on which the seal unit 50 is bonded, is repeatedly used by being remanufactured, it is easy to remanufacture the developer accommodating container 21 by replacing the seal unit 50 with a new (fresh) seal unit 50. In addition, by using the seal unit 50, even when the remanufacturing is repeated, there is no need to enlarge the partitioning portion 21*b*. For that reason, the developer accommodating container 21 can be downsized, so that it is possible to reduce the size of the cartridge 5.

Further, in this embodiment, the plate-like member 51*a* and the adhesive member 51*b* of the seal unit 50 were made the same shape.

As a result, for molding the plate-like member 51*a* and the adhesive member 51*b*, press working can be employed. In this press working, the plate-like member 51*a* and the adhesive member 51*b* can be molded simultaneously, so that productivity is improved.

[Embodiment 4]

In Embodiments 1 to 3, after the toner is re-filled into the developer accommodating portion 21*a* through the toner supply opening 21*b*1, the toner supply opening 21*b*1 is hermetically sealed with the seal unit 50. However, this is not restrictive of the present invention. Specifically, before the toner is re-filled into the developer accommodating portion 21*a*, the toner supply opening 21*b*1 may also be hermetically sealed with the seal unit 50. Thereafter, the toner is re-filled into the developer accommodating portion 21*a* through a through-opening that has been formed in the developing device frame 24 before or after the hermetical sealing. Thereafter, the through-opening is hermetically sealed by a known sealing method.

The structure and method of this embodiment are the same as those in Embodiments 1 to 3 in other respects.

As described above, according to the present invention, a remanufacturing method of a developing device and a remanufacturing method of a process cartridge, wherein a developer in a developer accommodating portion does not leak to the outside, even when the process cartridge is subjected to vibration or impact during transportation process, were realized.

Further, according to the present invention, easy remanufacturing methods of the developing device and the process cartridge were realized.

Further, according to the present invention, remanufacturing methods of the developing device and the process cartridge, capable of commercializing the developing device and the process cartridge, which lost their commercial values by consumption of the developer, were realized.

Further, according to the present invention, remanufacturing methods of the developing device and the process cartridge, wherein re-filling of the developer was realized by an easy method, were realized.

While the invention has been described with reference to the structures disclosed herein, it is not confined to the details set forth and this application is intended to cover such modifications or changes as may come within the purpose of the improvements or the scope of the following claims.

What is claimed is:

1. A remanufacturing method of a developing device that includes a developer accommodating portion partitioned by a partitioning portion, a first opening provided in the partitioning portion, and a seal member, welded on the partitioning portion, which surrounds the first opening, for sealing the first opening, wherein the first opening is opened for use by removing the seal member from the partitioning portion to supply a developer to outside of the developer accommodating portion through the first opening, said method comprising:

hermetically sealing, before or after re-filling the developer in the developer accommodating portion for reuse from which the seal member has been removed, the first opening, by bonding, on the partitioning portion, a plate-like member, which is provided with a second opening corresponding to the first opening and on which a reseal member for sealing the second opening is detachably bonded, at a region outside of a welding trace, a region inside of the welding trace, or a region ranging from an inside to an outside of the welding trace, so as to cover the welding trace.

2. A remanufacturing method according to claim 1, wherein the plate-like member is formed of a thermoplastic resin material and is bonded on the partitioning portion with a double-coated tape.

3. A remanufacturing method according to claim 1, wherein the second opening of the plate-like member has a size that is larger than the first opening.

4. A remanufacturing method according to claim 1, wherein the plate-like member is bonded from a direction opposing the first opening, so as to seal the first opening.

5. A developing device for use with an electrophotographic image forming apparatus, said developing device comprising:

a developer accommodating portion partitioned by a partitioning portion;

a first opening provided at a partitioning portion, for supplying a developer accommodated in said developer accommodating container to outside of the developer accommodating portion; and a plate-like member for hermetically sealing the first opening, wherein said plate-like member is provided with a second opening corresponding to the first opening and on which a reseal member for sealing the second opening is detachably bonded, and wherein said plate-like member is bonded, on the partitioning portion, at a region outside of a welding trace provided at the partitioning portion, a region inside of the welding trace, or a region ranging from an inside to an outside of the welding trace, so as to cover the welding trace.

6. A developing device according to claim 5, wherein the welding trace is a trace of a seal member welded on and then removed from said plate-like member.

7. A developing device according to claim 5, wherein said plate-like member is formed of a thermoplastic resin material and is bonded on the partitioning portion with a double-coated tape.

8. A developing device according to claim 5, wherein the second opening of said plate-like member has a size that is larger than said first opening.

9. A developing device according to claim 5, wherein said plate-like member is bonded from a direction opposing said first opening so as to seal said first opening.

10. A remanufacturing method of a process cartridge that includes an electrophotographic photosensitive member, a developing chamber provided with a developer carrying member for developing an electrostatic latent image formed on the electrophotographic photosensitive member with a developer, a developer accommodating portion partitioned from the developing chamber by a partitioning portion, a first opening provided in the partitioning portion, and a seal member, welded on the partitioning portion, which surrounds the first opening, for sealing the first opening, wherein the first opening is opened for use by removing the seal member from the partitioning portion to supply the developer from the developer accommodating portion to the developing chamber, said method comprising:

hermetically sealing, before or after re-filling the developer in the developer accommodating portion for reuse from which the seal member has been removed, the first opening, by bonding, on the partitioning portion, a plate-like member, which is provided with a second opening corresponding to the first opening and on which a reseal member for sealing the second opening is detachably bonded, at a region outside of a welding trace, a region inside of the welding trace, or a region ranging from an inside to an outside of the welding trace, so as to cover the welding trace.

11. A remanufacturing method according to claim 10, wherein the plate-like member is formed of a thermoplastic resin material and is boned on the partitioning portion with a double-coated tape.

12. A remanufacturing method according to claim 10, wherein the second opening of the plate-like member has a size that is larger than the first opening.

13. A remanufacturing method according to claim 10, wherein the plate-like member is bonded from a direction opposing the first opening, so as to seal the first opening.

14. A process cartridge detachably mountable to an electrophotographic image forming apparatus, said process cartridge comprising:

an electrophotographic photosensitive member;

a developing chamber provided with a developer carrying member for developing an electrostatic latent image formed on said electrophotographic photosensitive member with a developer;

a developer accommodating portion partitioned from said developing chamber by a partitioning portion;

a first opening provided at a partitioning portion, for supplying a developer accommodated in said developer accommodating container to said developing chamber; and a plate-like member for hermetically sealing the first opening, wherein said plate-like member is provided with a second opening corresponding to the first opening and on which a reseal member for sealing the second opening is detachably bonded, and wherein said plate-like member is bonded, on the partitioning portion, at a region outside of a welding trace provided at the partitioning portion, a region inside of the welding trace, or a region ranging from an inside to an outside of the welding trace, so as to cover the welding trace.

15. A process cartridge according to claim 14, wherein the welding trace is a trace of a seal member welded on and then removed from said plate like member.

16. A process cartridge according to claim 14, wherein said plate-like member is formed of a thermoplastic resin material and is bonded on the partitioning portion with a double-coated tape.

17. A process cartridge according to claim 14, wherein the second opening of said plate-like member has a size that is larger than said first opening.

18. A process cartridge according to claim 14, wherein said plate-like member is bonded from a direction opposing said first opening so as to seal said first opening.

* * * * *